US008989637B2

(12) United States Patent
Yoshii

(10) Patent No.: US 8,989,637 B2
(45) Date of Patent: Mar. 24, 2015

(54) DEVELOPING DEVICE AND IMAGE FORMING DEVICE

(71) Applicant: Fuji Xerox Co., Ltd., Tokyo (JP)

(72) Inventor: Tomoyuki Yoshii, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 97 days.

(21) Appl. No.: 13/782,264

(22) Filed: Mar. 1, 2013

(65) Prior Publication Data

US 2014/0016969 A1 Jan. 16, 2014

(30) Foreign Application Priority Data

Jul. 10, 2012 (JP) ..... 2012-154990

(51) Int. Cl.
*G03G 15/09* (2006.01)
*G03G 15/08* (2006.01)

(52) U.S. Cl.
CPC ..... *G03G 15/0865* (2013.01); *G03G 15/0921* (2013.01); *G03G 2215/0648* (2013.01)
USPC ..... 399/269

(58) Field of Classification Search
CPC ..... G03G 15/09; G03G 15/0921; G03G 2215/0648
USPC ..... 399/269, 277
See application file for complete search history.

(56) References Cited

U.S. PATENT DOCUMENTS

| | | | | |
|---|---|---|---|---|
| 4,266,868 | A * | 5/1981 | Bresina et al. | 399/269 |
| 5,987,288 | A * | 11/1999 | Mori et al. | 399/269 |
| 7,466,946 | B2 * | 12/2008 | Tsujita et al. | 399/269 |
| 8,331,832 | B2 * | 12/2012 | Ikeda et al. | 399/269 |
| 8,401,440 | B2 * | 3/2013 | Oba et al. | 399/269 |
| 2011/0229214 | A1 | 9/2011 | Oba et al. | |

FOREIGN PATENT DOCUMENTS

| | | |
|---|---|---|
| JP | A-2006-47840 | 2/2006 |
| JP | A-2007-47639 | 2/2007 |
| JP | A-2009-186614 | 8/2009 |
| JP | A-2011-197289 | 10/2011 |

* cited by examiner

*Primary Examiner* — William J Royer
(74) *Attorney, Agent, or Firm* — Oliff PLC

(57) ABSTRACT

A developing device including a first developer holding member disposed opposite to an image holding member that holds an electrostatic latent image, a second developer holding member, disposed opposite to the image holding member and the first developer holding member, a developer supply mechanism that supplies a developer to a position located further downstream than a development area in a direction of rotation of the second developer holding member and located further upstream than opposite locations of the two developer holding members, a regulation member that regulates the developer supplied by the developer supply mechanism, a developer division unit that divides the developer, supplied from the developer supply mechanism into two parts for the two developer holding members, and a developer carrying unit that holds and carries the developer after division toward the development area in a state where the developer is separated.

19 Claims, 23 Drawing Sheets

COMPARATIVE EXAMPLE

EXEMPLARY EMBODIMENT $g' < g1 \ll g''$ (SEE FIG. 5)

$\theta 1 < \theta 2$
$\gamma 1 > \gamma 2$

EXAMPLE

COMPARATIVE EXAMPLE

DEVELOPING DEVICE AND IMAGE FORMING DEVICE

CROSS-REFERENCE TO RELATED APPLICATIONS

This application is based on and claims priority under 35 USC 119 from Japanese Patent Application No. 2012-154990 filed Jul. 10, 2012.

BACKGROUND

Technical Field

The present invention relates to a developing device and an image forming device.

SUMMARY

According to an aspect of the invention, there is provided a developing device including: a first developer holding member, disposed opposite to an image holding member that holds an electrostatic latent image and cyclically moves, which rotates in a reverse direction to the image holding member at an opposite location to the image holding member and holds and carries developer, containing toner and magnetic carrier, toward a first development area on which the electrostatic latent image on the image holding member is developed; a second developer holding member, disposed opposite to the image holding member and the first developer holding member at the side located further downstream of the image holding member in a direction of movement than the first developer holding member, which rotates in the same direction as the first developer holding member at an opposite location to the first developer holding member and holds and carries the developer toward a second development area on which the electrostatic latent image on the image holding member is developed; a developer supply mechanism that supplies the developer to a position located further downstream than the second development area in a direction of rotation of the second developer holding member and located further upstream than opposite locations of the two developer holding members, with respect to any one of the first and second developer holding members; a regulation member that regulates the developer supplied by the developer supply mechanism to an amount necessary to be provided for use in development at both the first and second developer holding members; a developer division unit that has dividing magnetic poles having polarities different from each other, respectively disposed at the opposite locations of the first and second developer holding members, and divides the developer, supplied from the developer supply mechanism due to a dividing magnetic field formed by the dividing magnetic poles and carried to the opposite locations of the two developer holding members, into two parts for the two developer holding members; and a developer carrying unit that has carrying magnetic poles, respectively, disposed between each of the dividing magnetic poles and each developing magnetic pole corresponding to each of the development areas in the first and second developer holding members, the carrying magnetic poles having a polarity different from both the poles, and holds and carries the developer after division toward each of the development areas in a state where the developer after division is separated, while increasing a magnetic flux density of a location adjacent to the developer division unit further than when the carrying magnetic poles are not present due to a magnetic flux density distribution of the carrying magnetic poles.

BRIEF DESCRIPTION OF THE DRAWINGS

Exemplary embodiments of the present invention will be described in detail based on the following figures, wherein:

FIG. 7A is a diagram illustrating a case where two developing rollers are separated from each other to such an extent that a magnetic action is not caused to act therebetween, and FIG. 7B is a diagram illustrating a case where two developing rollers are in close proximity to each other so as to cause a magnetic action to act therebetween;

FIG. 8A is a diagram illustrating a case where two developing rollers are separated from each other to such an extent that a magnetic action is not caused to act therebetween, and FIG. 8B is a diagram illustrating a case where two developing rollers are in close proximity to each other so as to cause a magnetic action to act therebetween;

FIG. 10A is a diagram illustrating a case where a dividing magnetic pole of a first developing roller is biasedly disposed at the side located further upstream than a dividing magnetic pole of a second developing roller as in Exemplary Embodiment 1, FIG. 10B is a diagram illustrating a case where the dividing magnetic poles of the first developing roller and the second developing roller are disposed at positions opposite to each other, and FIG. 10C is a diagram illustrating a case where the dividing magnetic pole and a carrying magnetic pole of the first developing roller are biasedly disposed at the side located further downstream than the dividing magnetic pole of the second developing roller;

FIG. 11A is a diagram illustrating a case where the carrying magnetic pole is larger than the dividing magnetic pole, and FIG. 11B is a diagram illustrating a case where the carrying magnetic pole is smaller than the dividing magnetic pole;

DETAILED DESCRIPTION

Outline of Exemplary Embodiment

First, an outline of an exemplary embodiment of a developing device to which the invention is applied will be described.

Figure 1:
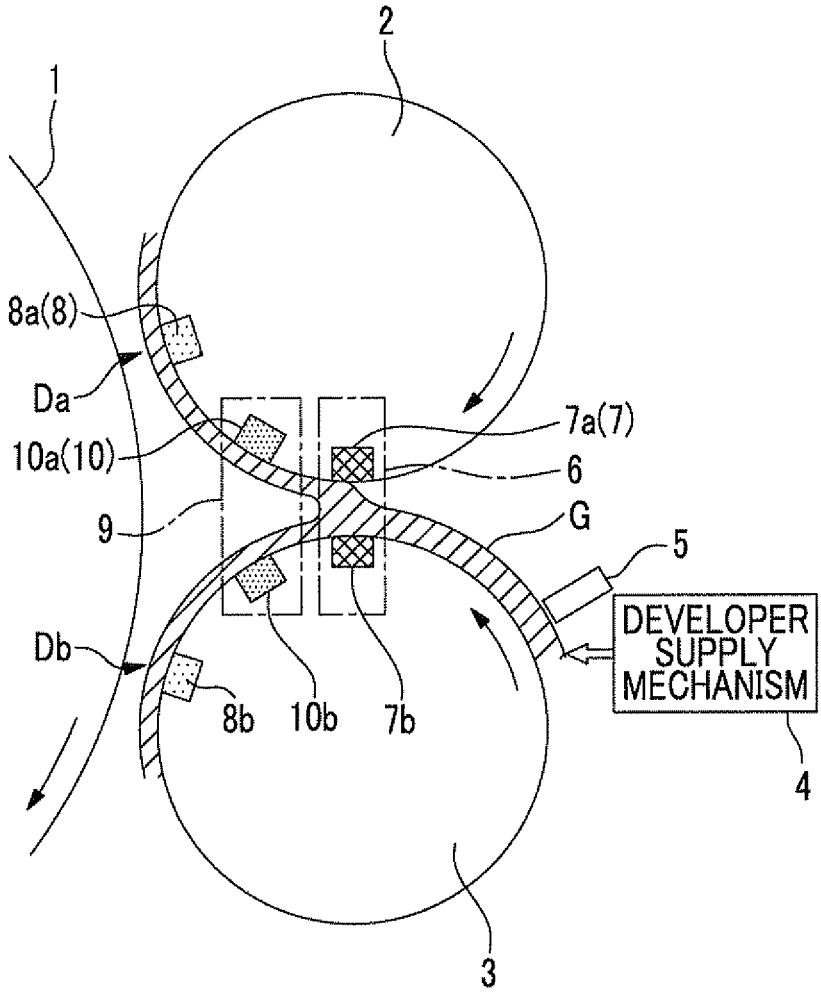
FIG. 1 is a schematic diagram illustrating an outline of an exemplary embodiment of a developing device to which the invention is applied.

FIG. 1 is a schematic diagram illustrating an outline of a developing device according to a model of an exemplary embodiment for embodying the invention. The developing device includes a first developer holding member 2, disposed opposite to an image holding member 1 that holds an electrostatic latent image and cyclically moves, which rotates in a reverse direction to the image holding member 1 at an opposite location to the image holding member 1 and holds and carries developer G, containing toner and magnetic carrier, toward a development area Da on which the electrostatic latent image on the image holding member 1 is developed, a second developer holding member 3, disposed opposite to the image holding member 1 and the first developer holding member 2 at the side located further downstream of the image holding member 1 in the direction of movement than the first developer holding member 2, which rotates in the same direction as the first developer holding member 2 at an opposite location to the first developer holding member 2 and holds and carries the developer G toward a development area Db on which the electrostatic latent image on the image holding member 1 is developed, a developer supply mechanism 4 that supplies the developer G to a position located further downstream than the development area Db in the direction of rotation of the second developer holding member 3 and located further upstream than opposite locations of the two developer holding members 2 and 3, with respect to any one of the first and second developer holding members 2 and 3, a regulation member 5 that regulates the developer G supplied by the developer supply mechanism 4 to the amount necessary to be provided for use in development at both the first and second developer holding members 2 and 3, a developer division unit 6 that has dividing magnetic poles 7 (7*a* and 7*b*) having polarities different from each other, respectively, disposed at the opposite locations of the first and second developer holding members 2 and 3, and divides the developer G, supplied from the developer supply mechanism 4 due to a dividing magnetic field formed by the dividing magnetic poles 7 and carried to the opposite locations of the two developer holding members 2 and 3, into two parts for the two developer holding members 2 and 3, and a developer carrying unit 9 that has carrying magnetic poles 10 (10*a* and 10*b*), respectively, disposed between each of the dividing magnetic poles 7 and each of developing magnetic pole 8 (8*a* and 8*b*) corresponding to each of the development areas Da and Db in the first and second developer holding members 2 and 3, the carrying magnetic poles 10 having a polarity different from both these poles, and holds and carries the developer G after division toward each of the development areas Da and Db in a state where the developer G is separated, while increasing a magnetic flux density of a location adjacent to the developer division unit 6 further than when the carrying magnetic poles 10 are not present due to a magnetic flux density distribution of the carrying magnetic poles 10.

Here, the first and second developer holding members 2 and 3 just need to be able to hold and carry the developer (two-component developer) G containing toner and magnetic carrier on the peripheral surfaces thereof, and the peripheral surfaces of the two developer holding members 2 and 3 are subjected to grooving, roughening treatment or the like so that the developer G is carried. A typical example of such developer holding members 2 and 3 includes a configuration in which a non-magnetic cylindrical rotating member is included on the surfaces thereof, and a magnet member that has a permanent magnet fixedly disposed in the inside of the rotating member is included.

In addition, the developer supply mechanism 4 just needs to supply the developer G to any one of the first and second developer holding members 2 and 3. In the present example, an example in which the developer G is supplied to the second developer holding member 3 side is shown, but the developer G may be supplied to the first developer holding member 2 side without being limited thereto. Further, since the regulation member 5 regulates the developer G so that the necessary amount of developer G is carried to the opposite locations of the two developer holding members 2 and 3, the regulation member 5 may be provided opposite to the second developer holding member 3, and may regulate the developer G before the developer G is supplied to the second developer holding member 3.

The developer division unit 6 divides the developer G, carried to the opposite locations of the two developer holding members 2 and 3 in the second developer holding member 3, into two parts for the first and second developer holding members 2 and 3, and thus the developer G is divided due to a dividing magnetic field formed by the dividing magnetic poles 7 (7*a* and 7*b*) having polarities different from each other. Since members are not disposed on the opposite locations of the two developer holding members 2 and 3 by including such a developer division unit 6, excessive stress is not also given to the developer G. In addition, when the developer G is divided, the developer G is divided by the dividing magnetic poles 7. Therefore, even when the amount of developer G increases or decreases, the developer G is divided at a stable division ratio. Such dividing magnetic poles 7 (7*a* and 7*b*) may be disposed corresponding to nearest-neighbor locations of the two developer holding members 2 and 3, and are allowed to be biased to each other within a range in which a dividing magnetic field acts.

In addition, the developer carrying unit 9 carries the developer G, divided into two parts for the two developer holding members 2 and 3 by the developer division unit 6, toward each of the development areas Da and Db. The magnetic flux density of a location adjacent to the developer division unit 6 is increased due to the magnetic flux density distribution of such carrying magnetic poles 10, the magnitude of the magnetic flux density of the carrying magnetic poles 10 is set to such a magnitude as to carry the developer G divided by the developer division unit 6 in a state where the developer G is separated, and the developer G after division is not delivered between the two developer holding members 2 and 3 due to a magnetic field caused by the carrying magnetic poles 10 after division.

Here, a flow of the developer G when the developer division unit 6 and the developer carrying unit 9 are included will be described.

Figure 2A:
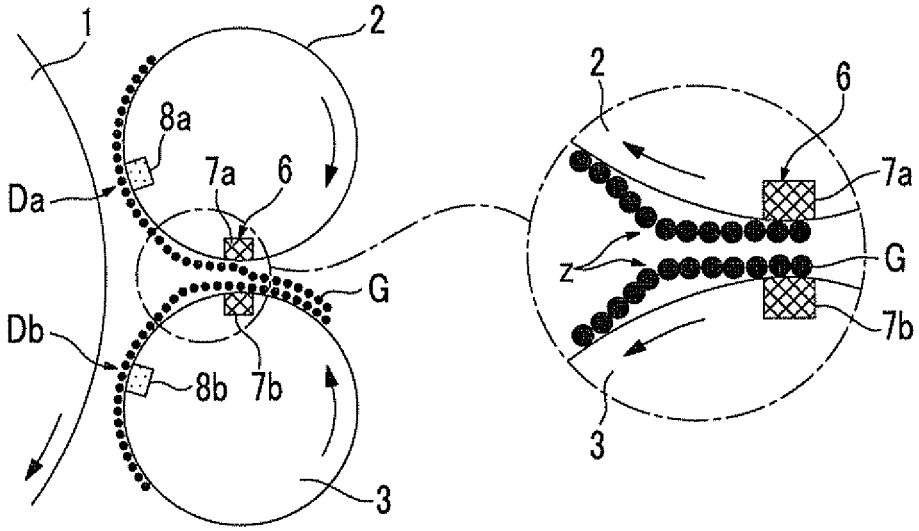
FIG. 2A is a diagram illustrating an action in a case where only dividing magnetic poles used in a developing device according to a comparative example are included.
Figure 2B:
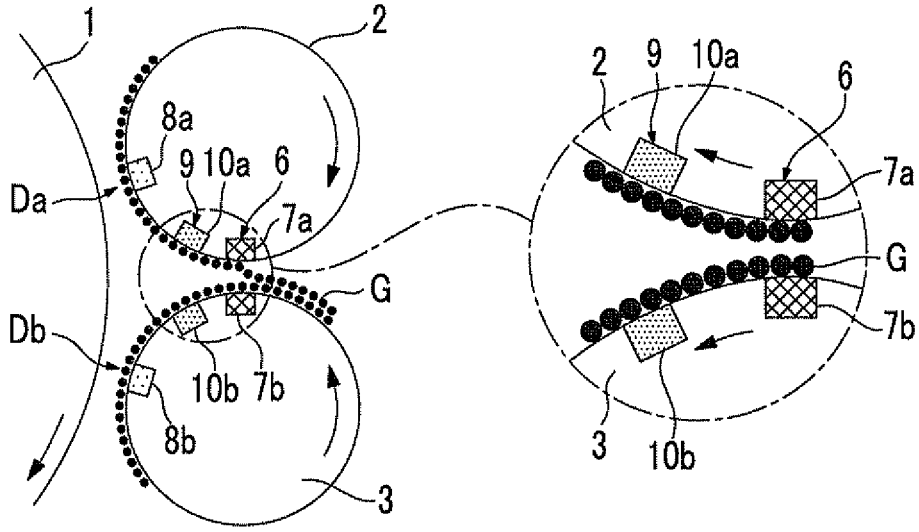
FIG. 2B is a diagram illustrating an action in a case where dividing magnetic poles and carrying magnetic poles used in a developing device according to an exemplary embodiment are included.

FIG. 2A is a diagram illustrating a flow of the developer G in an example in which each of the developer holding members 2 and 3 includes only the developer division unit 6 constituted by the dividing magnetic poles 7 (7*a* and 7*b*) and does not include the developer carrying unit 9, as a comparative example, and FIG. 2B is a diagram illustrating a flow of the developer G in an example in which each of the developer holding members 2 and 3 includes the developer division unit 6 and the developer carrying unit 9, as in the exemplary embodiment.

As shown in FIG. 2A, in the example in which the first and second developer holding members 2 and 3 include only the developer division unit 6, the flow of the developer G is thought to be as follows. The developer G supplied to the opposite locations of the two developer holding members 2 and 3 is divided into two parts for the two developer holding members 2 and 3 by the developer division unit 6 constituted by the dividing magnetic poles 7*a* and 7*b* having polarities different from each other. Here, both the developer holding members 2 and 3 do not have any magnetic poles between the dividing magnetic poles 7*a* and 7*b* and the developing magnetic poles 8*a* and 8*b* located at the development areas Da and Db. Therefore, in the developer G nipped by the dividing magnetic poles 7*a* and 7*b*, a force received from the developer holding members 2 and 3 between the dividing magnetic poles 7*a* and 7*b* and the developing magnetic poles 8*a* and 8*b* considerably decreases. At this time, since the distances from the dividing magnetic poles 7*a* and 7*b* to the developing magnetic poles 8*a* and 8*b* are long, the divided developer G is not constrained by each of the developer holding members 2 and 3, and thus the developer G peels off. For this reason, it is hard to stabilize the flow of the developer G after division, and the mutual contact of the developer G between each of the developer holding members 2 and 3 after division also tends to occur. Therefore, it is difficult to maintain the amount of developer G based on a stable division ratio in the developer G after division. Further, a variation in the layer thickness of the developer G reaching the developing magnetic poles 8*a* and 8*b* also increases, and thus there may be a concern of image non-uniformity, for example, being generated at the time of development.

On the other hand, as shown in FIG. 2B, in the example in which the first and second developer holding members 2 and 3 include the developer division unit 6 and the developer carrying unit 9, the flow of the developer G is thought to be as follows. In each of the developer holding members 2 and 3, the developer division unit 6 constituted by the dividing magnetic poles 7*a* and 7*b* and the developer carrying unit 9 constituted by the carrying magnetic poles 10*a* and 10*b* are disposed close to each other, and the magnitude of the magnetic flux density is sufficiently secured between the dividing magnetic poles 7*a* and 7*b* and the carrying magnetic poles 10*a* and 10*b* in each of the developer holding members 2 and 3. For this reason, the peeling off of the developer G after division from each of the developer holding members 2 and 3 is suppressed, and the developer G os sufficiently constrained by the developer holding members 2 and 3. Thereby, the mutual contact of the developer G between each of the developer holding members 2 and 3 after division is also suppressed, and the developer G of which the amount of developer G having a stable division ratio in the developer G after division is maintained is carried toward each of the development areas Da and Db. In addition, in such developer G carried toward the development areas Da and Db, a variation in the layer thickness of the developer G is suppressed to an extent that the peeling off thereof from each of the developer holding members 2 and 3 is suppressed, and the occurrence of image non-uniformity is also suppressed at the time of development.

Further, in FIG. 1, from the viewpoint of dividing the developer G through the developer division unit 6 at a division ratio which is set in advance, the developer division unit 6 is preferably configured such that the central position of a magnetic pole width along the circumferential direction of the dividing magnetic pole 7*a* of the first developer holding member 2, out of the dividing magnetic poles 7*a* and 7*b*, located on a different side from the second developer holding member 3 to which the developer G is supplied by the developer supply mechanism 4 is set to be biased toward the upstream side of the first developer holding member 2 in the direction of rotation, with respect to the central position of a magnetic pole width along the circumferential direction of the dividing magnetic pole 7*b* of the second developer holding member 3 to which the developer G is supplied by the developer supply mechanism 4. In this manner, one dividing magnetic pole 7*a* is biased further toward the upstream side than the other, and thus an action of suctioning the developer G to the first developer holding member 2 side is caused to be exerted against a developer carrying force of the developer G carried onto the second developer holding member 3 toward the opposite location. Further, thereafter, an action of returning a portion of the developer G suctioned a great deal is caused to be exerted, and thus the developer G is divided at a division ratio which is set in advance. At this time, peak values of a normal component of magnetic flux density in the two dividing magnetic poles 7*a* and 7*b* are made approximately equal to each other, and thus the division ratio is easily divided equally. In addition, when the peak values of a normal component of magnetic flux density in the two dividing magnetic poles 7*a* and 7*b* are changed, the division ratio changes depending on the peak values. Meanwhile, a detailed description thereof will be made later.

In addition, from the viewpoint of further stabilizing the flow of the developer G divided by the developer division unit 6, when a half-value width of a normal component of magnetic flux density caused by the dividing magnetic pole 7 of each of the developer holding members 2 and 3 is set to θ1, and a half-value width of a normal component of magnetic flux density caused by the carrying magnetic pole 10 is set to θ2, both the dividing magnetic pole 7 and the carrying magnetic pole 10 in each of the developer holding members 2 and 3 are preferably set to satisfy a relationship of θ1<θ2. In this manner, the half-value width of the carrying magnetic pole 10 is made to be larger than the half-value width of the dividing magnetic pole 7, and thus the magnetic flux density acting on the developer G immediately after division increases, which leads to a further suppression of the peeling off of the developer G immediately after division from the developer holding members 2 and 3. Meanwhile, a detailed description thereof will be made later.

Further, from the viewpoint of further suppressing the peeling off of the developer G from the developer holding members 2 and 3 at the time of carrying the developer G in the developer carrying unit 9, the developer carrying unit 9 is preferably configured such that the central position of a magnetic pole width along the circumferential direction of the carrying magnetic pole 10*a* on the first developer holding member 2 side, out of the carrying magnetic poles 10, located on a different side from the second developer holding member 3 to which the developer G is supplied by the developer supply mechanism 4 is set to be biased toward the upstream side of the first developer holding member 2 in the direction of rotation, with respect to the central position of a magnetic pole width along the circumferential direction of the carrying magnetic pole 10*b* of the second developer holding member 3 to which the developer G is supplied by the developer supply mechanism 4. When the carrying magnetic poles 10*a* and 10*b* are thus biasedly disposed, the developer G divided to the first developer holding member 2 to which the developer G is not supplied can be further prevented from peeled off from the first developer holding member 2, which leads to a further stabilization of the carrying of the developer G. In such a biased arrangement, it is suitable that both the dividing magnetic pole 7*a* and the carrying magnetic pole 10*a* of the first developer holding member 2 to which the developer G is not supplied be biasedly disposed at the upstream side.

In addition, from the viewpoint of improving the carrying property of the developer G while simplifying the configurations of the developer holding members 2 and 3, preferably, the second developer holding member 3 to which the developer G is supplied by the developer supply mechanism 4 includes at least the developing magnetic pole 8*b*, the dividing magnetic pole 7*b* and the carrying magnetic pole 10*b*, and includes seven magnetic poles in the inside thereof along the direction of rotation of the second developer holding member 3. Seven magnetic poles are included, so that it is possible to cause the second developer holding member 3 to have functions of the suction of the developer G to the regulation, division, carrying, development, carrying, and peeling thereof, and operations from the attachment of the developer G to the peeling off thereof are effectively performed in the second developer holding member 3.

In order to apply such a developing device to an image forming device, the image holding member 1 that holds an electrostatic latent image and cyclically moves and the above-mentioned developing device as a developing device which is provided opposite to the image holding member 1 and develops the electrostatic latent image on the image holding member 1 with the developer G may be used. Such an image holding member 1 may be not only drum-shaped, but also belt-shaped.

In addition, the image forming device is not limited to an example in which the first and second developer holding members 2 and 3 are included, but an additional developer holding member may be applied to one image holding member 1 in addition to the first and second developer holding members 2 and 3. Such an example includes the following example. That is, one or plural additional developer holding members, provided separately from the first and second developer holding members 2 and 3, which are disposed opposite to the image holding member 1 and hold and carry the developer G toward a development area opposite to the image holding member 1, and a delivery unit that delivers the developer G, held and carried on the first and second developer holding members 2 and 3, to the additional developer holding members may be included.

Here, the additional developer holding members may be disposed on one side of the first and second developer holding members 2 and 3, or may be disposed on both sides. In addition, an additional developer holding member is allowed to be included at the side located further upstream or downstream than the additional developer holding member with the delivery unit interposed therebetween.

The developer carrying unit 9 can include plural carrying magnetic poles 10 in each of the developer holding members 2 and 3. In this case, the developing device may be configured as follows. That is, the developing device may include the first developer holding member 2, disposed opposite to the image holding member 1 that holds an electrostatic latent image and cyclically moves, which rotates in a reverse direction to the image holding member 1 at an opposite location to the image holding member 1 and holds and carries developer G, containing toner and magnetic carrier, toward a development area Da on which the electrostatic latent image on the image holding member 1 is developed, the second developer holding member 3, disposed opposite to the image holding member 1 and the first developer holding member 2 at the side located further downstream of the image holding member 1 in the direction of movement than the first developer holding member 2, which rotates in the same direction as the first developer holding member 2 at an opposite location to the first developer holding member 2 and holds and carries the developer G toward a development area Db on which the electrostatic latent image on the image holding member 1 is developed, the developer supply mechanism 4 that supplies the developer G to a position located further downstream than the development area Db in the direction of rotation of the second developer holding member 3 and located further upstream than opposite locations of the two developer holding members 2 and 3, with respect to any one of the first and second developer holding members 2 and 3, the regulation member 5 that regulates the developer G supplied by the developer supply mechanism 4 to the amount necessary to be provided for use in development at both the first and second developer holding members 2 and 3, the developer division unit 6 that has dividing magnetic poles 7 having polarities different from each other, respectively, disposed at the opposite locations of the first and second developer holding members 2 and 3, and divides the developer G, supplied from the developer supply mechanism 4 due to a dividing magnetic field formed by the dividing magnetic poles 7 and carried to the opposite locations of the two developer holding members 2 and 3, into two parts for the two developer holding members 2 and 3, and the developer carrying unit 9 that has one or more carrying magnetic poles 10 disposed between each of the dividing magnetic poles 7 and each developing magnetic pole 8 corresponding to each of the development areas Da and Db in the first and second developer holding members 2 and 3 so that magnetic poles adjacent to each other including the dividing magnetic poles 7 and developing magnetic poles 8 have different polarities, and holds and carries the developer G after division toward each of the development areas Da and Db in a state where the developer is separated, while increasing a magnetic flux density of a location adjacent to the developer division unit 6 further than when the carrying magnetic poles 10 are not present due to a magnetic flux density distribution of the carrying magnetic poles 10. In such an example, the number of carrying magnetic poles 10 is not limited, but plural carrying magnetic poles 10 may be included in both of each of the developer holding members 2 and 3, and one carrying magnetic pole 10 may be included in one side and plural carrying magnetic poles 10 may be included in the other side.

Next, the invention will be described in more detail on the basis of exemplary embodiments shown in the drawings.

Exemplary Embodiment 1

Figure 3:
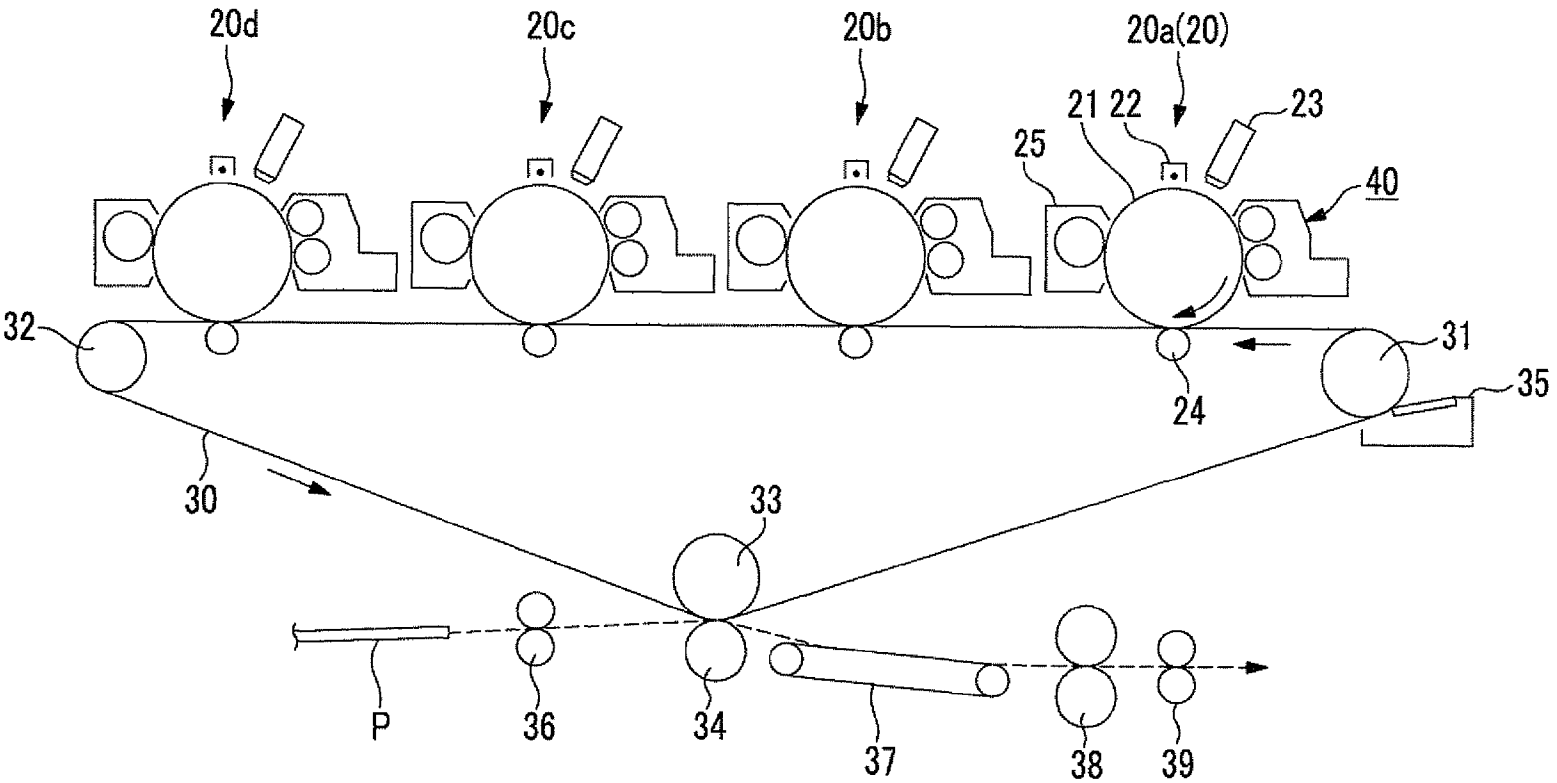
FIG. 3 is a schematic diagram illustrating an outline of an image forming device according to Exemplary Embodiment 1.

FIG. 3 is a schematic diagram illustrating an outline of an image forming device of Exemplary Embodiment 1 using the developing device to which the invention is applied. In the same drawing, the image forming device of the exemplary embodiment is configured such that, for example, an electrophotographic system is adopted, and imaging devices 20 (20*a* to 20*d*) that performs imaging by four-color developer (two-component developer) containing toner and magnetic carrier are disposed side by side on the approximately linear portion of an intermediate transfer belt 30 that cyclically rotates.

<Entire Configuration of Image Forming Device>

Since each of the imaging devices 20 (specifically, 20*a* to 20*d*) has substantially the same configuration, one imaging device 20*a* will be described herein as the typical imaging device 20. The imaging device 20 includes a photoreceptor 21 as an image holding member that holds an electrostatic latent image and rotates, a developing device 40, provided opposite to the photoreceptor 21, which develops the electrostatic latent image on the photoreceptor 21 with developer, and the like. Further, the periphery of the photoreceptor 21 is provided with a charger 22 for charging a photosensitive layer of the photoreceptor 21 to a potential which is set in advance, an exposure unit 23 that performs exposure so that a latent image based on an image signal is formed on the photoreceptor 21 charged by the charger 22, the above-mentioned developing device 40 that develops the latent image formed by the exposure using the exposure unit 23 with developer and visualizes the latent image, a primary transfer roller 24 that transfers a toner image visualized by the developing device 40 onto the intermediate transfer belt 30, a cleaning unit 25 that cleans off residues on the photoreceptor 21 after the toner image is transferred, and the like.

Here, an example of a corona charger is shown as the charger 22, but, for example, a contact-type charging system is allowed to be adopted without being limited thereto. In addition, an example of an LED array type is shown as the exposure unit 23, but, for example, a laser scanning type may be adopted. Further, an example of contact with the intermediate transfer belt 30 is shown as the primary transfer roller 24, but a system in which the primary transfer roller is separated from the intermediate transfer belt 30, for example, using a corona charger may be adopted.

The intermediate transfer belt 30 is hung over plural tension rollers 31 to 33, and cyclically rotates using, for example, the tension roller 31 as a driving roller. Further, a secondary transfer roller 34 is disposed at a position opposite to the tension roller 33 with the intermediate transfer belt 30 interposed therebetween. Using the tension roller 33 as a back-up roller, a secondary transfer electric field is caused to act between the secondary transfer roller 34 and the back-up roller 33, and thus a toner image on the intermediate transfer belt 30 is transferred onto a recording material P. Reference numeral 35 in the drawing denotes a belt cleaning unit that cleans off residual toner on the intermediate transfer belt 30. Meanwhile, in the present example, an example in which the intermediate transfer belt 30 is used is shown, but, for example, a drum-shaped intermediate transfer member may be used instead of the intermediate transfer belt 30. Further, using a recording material transport belt that holds and carries a recording material instead of the intermediate transfer belt 30, toner images created by the imaging devices 20 may be sequentially transferred onto the recording material held on the recording material transport belt.

In addition, in the exemplary embodiment, the recording material P is supplied to a secondary transfer location, a transporting path of the recording material P before the recording material P is discharged from the secondary transfer location is provided, and the transporting path is provided with the following members. Registration rollers 36 that position the recording material P directed toward the secondary transfer location and transport the positioned recording material P toward the secondary transfer location at a preset timing are provided at positions adjacent to each other at the upstream side of the secondary transfer location in the transporting direction of the recording material P. In addition, a transport belt 37 that transports the recording material P to which the toner image is transferred at the secondary transfer location, fixing rollers 38 that fix a non-fixed toner image on the recording material P at the downstream side of the transport belt 37, discharge rollers 39 that discharge the recording material P, to which the non-fixed toner image is fixed by the fixing rollers 38 at the downstream side of the fixing rollers 38, to the outside of the image forming device, and the like are disposed at the side located further downstream than the secondary transfer location.

<Configuration of Developing Device>

Figure 4:
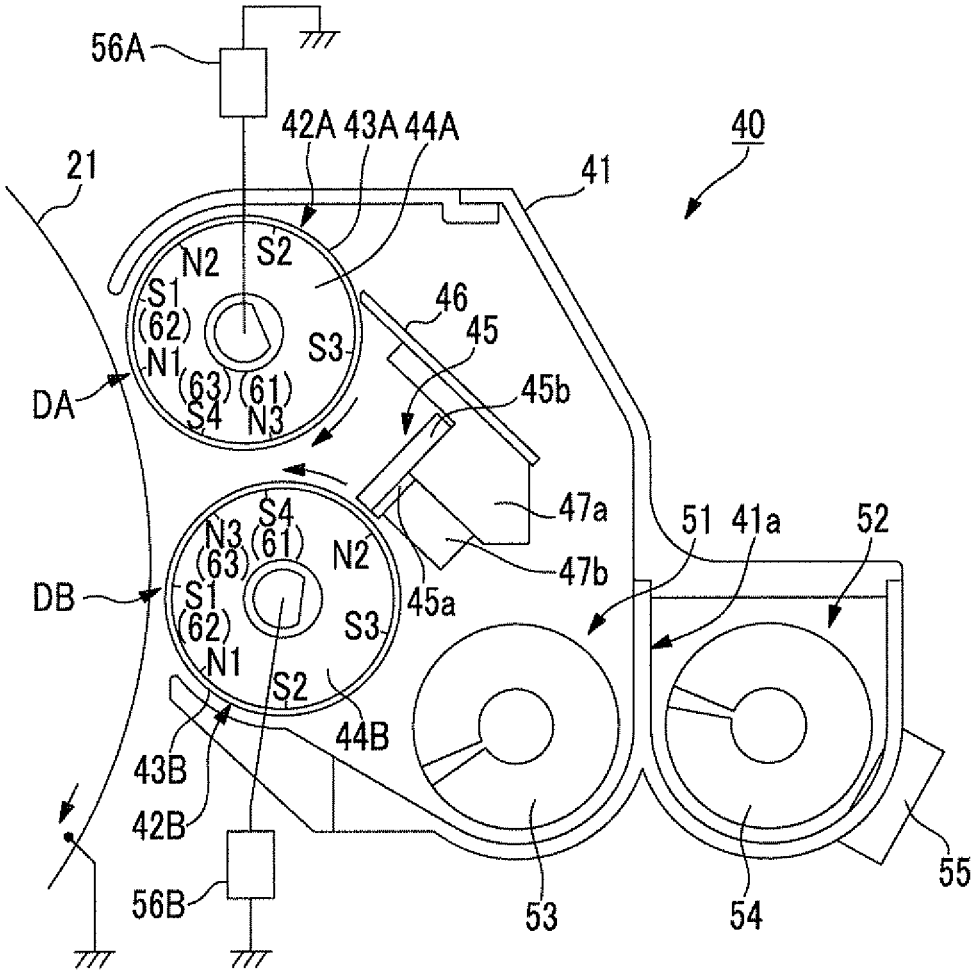
FIG. 4 is a schematic diagram illustrating an outline of a developing device according to Exemplary Embodiment 1.

The developing device 40 of the exemplary embodiment is formed as shown in FIG. 4. The developing device 40 is provided with two developer holding members disposed opposite to the photoreceptor 21, corresponding to an opening of a developing container 41. These developer holding members are constituted by a first developing roller 42A as a first developer holding member and a second developing roller 42B as a second developer holding member. The first developing roller 42A rotates in a reverse direction to the photoreceptor 21 at the opposite location to the photoreceptor 21, and holds and carries developer containing toner and magnetic carrier toward a development area DA. On the other hand, the second developing roller 42B is disposed at the side located further downstream than the first developing roller 42A in the direction of rotation of the photoreceptor 21, rotates in the same direction as the photoreceptor 21 at the opposite location to the photoreceptor 21, and holds and carries the developer toward a development area DB.

The first developing roller 42A includes a developing sleeve 43A (non-magnetic cylindrical rotating member) that holds and carries the developer on the peripheral surface and a magnet member 44A which is fixedly provided within the developing sleeve 43A and in which a magnet is disposed in the magnetic pole arrangement set in advance. In addition, similarly to the first developing roller 42A, the second developing roller 42B also includes a developing sleeve 43B that holds and carries the developer on the peripheral surface and a magnet member 44B which is fixedly provided within the developing sleeve 43B and in which a magnet is disposed in the magnetic pole arrangement set in advance. On the peripheral surface of each of the developing sleeves 43A and 43B, V-shaped grooves, for example, extending along the width direction intersecting the direction of rotation thereof are formed at intervals set in advance along the direction of rotation.

In the magnetic pole arrangement in the magnet members 44A and 44B, each magnetic pole is disposed so that the developer is sufficiently carried, and in the present example, both the magnet members 44A and 44B have seven magnetic poles disposed in the insides thereof along the direction of rotation. In the magnet member 44A of the first developing roller 42A, an N1 pole as a developing magnetic pole 62 corresponding to the development area DA is disposed, and an S1 pole, an N2 pole, an S2 pole, an S3 pole, an N3 pole, and an S4 pole are disposed in order along the direction of rotation of the first developing roller 42A. Here, the S1 pole and the N2 pole are magnetic poles for carrying the developer. The S2 pole is a magnetic pole for peeling off the developer from the first developing roller 42A, and peels off the developer from the first developing roller 42A due to a repulsion magnetic field between the S2 pole and the S3 pole, having the same polarity, which are adjacent to each other at the downstream side. In addition, the N3 pole is a dividing magnetic pole 61 constituting the developer division unit, and the S4 pole is a carrying magnetic pole 63 constituting the developer carrying unit.

On the other hand, in the magnet member 44B of the second developing roller 42B, an S1 pole as a developing magnetic pole 62 is disposed at a position corresponding to the development area DB, and an N1 pole, an S2 pole, an S3 pole, an N2 pole, an S4 pole, and an N3 pole are disposed in order along the direction of rotation of the second developing roller 42B. Here, the N1 pole is a magnetic pole for carrying the developer. The S2 pole is a magnetic pole for peeling off the developer from the second developing roller 42B, and peels off the developer from the second developing roller 42B due to a repulsion magnetic field between the S2 pole and the S3 pole, having the same polarity, which are adjacent to each other at the downstream side. The S3 pole is a magnetic pole for suctioning the developer to the second developing roller 42B, and the developer is supplied to the second developing roller 42B due to a suction action of the S3 pole. In addition, the N2 pole is a regulating magnetic pole disposed for a regulation member 45 (described later) that regulates the layer thickness of the developer supplied to the second developing roller 42B. Further, the S4 pole is the dividing magnetic pole 61 constituting the developer division unit, and the N3 pole is the carrying magnetic pole 63 constituting the developer carrying unit. Meanwhile, the magnetic pole arrangement in the first developing roller 42A and the second developing roller 42B is not limited to the above example, but may be appropriately selected without interfering with the flow of the developer.

Figure 5:
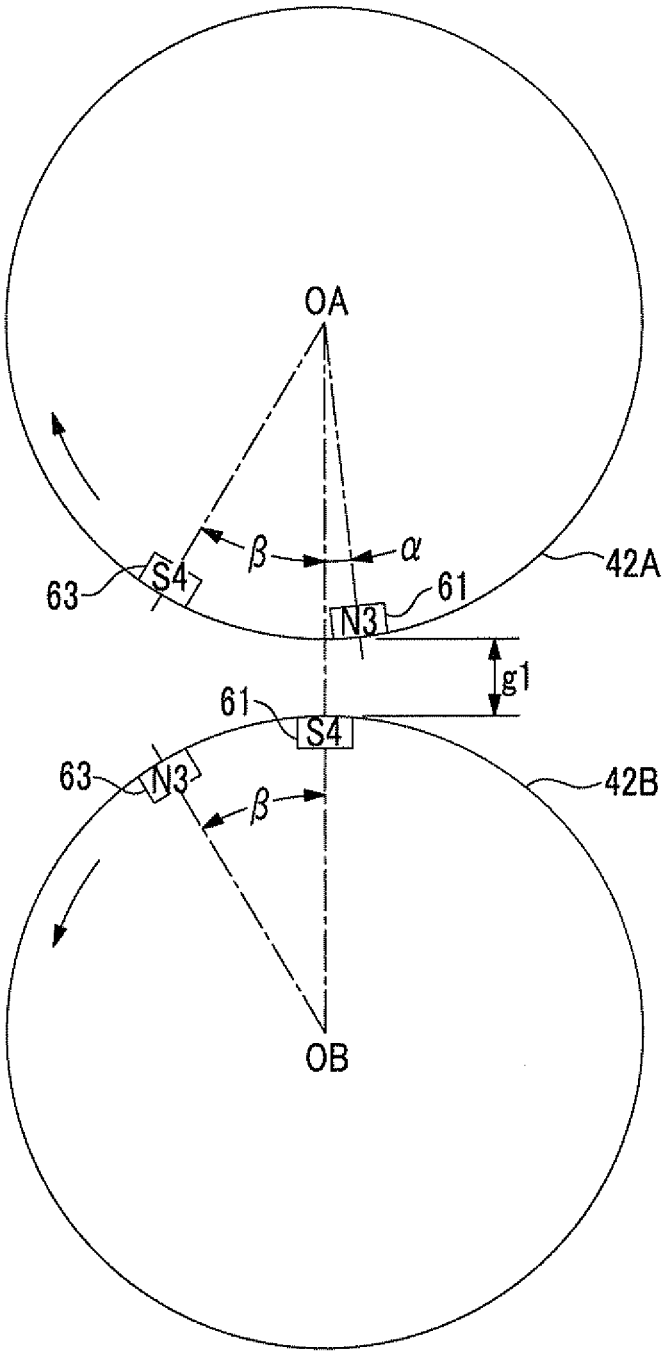
FIG. 5 is a diagram illustrating a magnetic pole arrangement according to Exemplary Embodiment 1.

The dividing magnetic poles 61 and the carrying magnetic poles 63 of the exemplary embodiment are disposed as shown in FIG. 5. That is, in the first developing roller 42A, the angle between a line segment that links a central axis OA and the center of the dividing magnetic pole 61 in the circumferential direction and a line segment that links the central axis OA and the center of the carrying magnetic pole 63 in the circumferential direction is $\alpha+\beta$. On the other hand, in the second developing roller 42B, the angle between a line segment that links a central axis OB and the center of the dividing magnetic pole 61 in the circumferential direction and a line segment that links the central axis OB and the center of the carrying magnetic pole 63 in the circumferential direction is $\beta$. That is, the dividing magnetic pole 61 of the first developing roller 42A is disposed to be biased by the angle $\alpha$ at the side located further upstream in the direction of rotation of the first developing roller 42A than a line segment that links the central axis OA of the first developing roller 42A and the central axis OB of the second developing roller 42B.

Here, the first developing roller 42A and the second developing roller 42B of the exemplary embodiment are configured so that the line segment that links the mutual central axes OA and OB is directed toward the vertical direction, in order to make it easier to understand, but specifically as shown in FIG. 4, these rollers are disposed with an inclination of 7 degrees or so (first developing roller 42A is inclined toward the photoreceptor 21 side). In addition, sign g1 in the drawing means a gap between the first developing roller 42A and the second developing roller 42B. Meanwhile, in FIG. 5, the dividing magnetic pole 61 (S4) is located on the line that links the central axes OA and OB, but is obviously not limited thereto.

Further, power supplies 56A and 56B, for example, for supplying a voltage obtained by superimposing an alternating electric field on a direct electric field are connected to the first developing roller 42A and the second developing roller 42B, and a development electric field is caused to act between, for example, the grounded photoreceptor 21 and each of the developing rollers 42A and 42B.

Two resin blocks 47*a* and 47*b* supported by the developing container 41 are disposed behind the first developing roller 42A and the second developing roller 42B within the developing container 41. The regulation member 45 is installed on these resin blocks 47*a* and 47*b*, and is configured to regulate the layer thickness of the developer on the second developing roller 42B between the regulation member 45 and the N2 pole as a regulating magnetic pole of the second developing roller 42B. The regulation member 45 of the exemplary embodiment is constituted by a regulating piece 45*a* which is disposed on the side close to the N2 pole of the second developing roller 42B and is made of a magnetic material and a regulating plate 45*b* which is disposed next to the regulating piece 45*a* at the side located further downstream in the direction of rotation of the second developing roller 42B than the regulating piece 45*a* and is made of a non-magnetic material having a larger thickness than that of the regulating piece 45*a*. In addition, a guide member 46 that guides the developer peeled off from the first developing roller 42A downward is obliquely provided above the resin block 47*a*.

Further, a developer stirring mechanism, which stirs and carries developer, for supplying the stirred developer to the second developing roller 42B is provided behind the second developing roller 42B within the developing container 41. The developer stirring mechanism includes two developer carrying paths 51 and 52 extending substantially parallel to each other using a partition wall 41*a* (constituting a portion of the developing container 41) extending along the axial directions of the first and second developing rollers 42A and 42B as a boundary, and the developer carrying paths 51 and 52 are respectively provided with stirring carrying members 53 and 54 that stir and carry the developer by rotating a spiral blade. In addition, passages, not shown, which connect the two developer carrying paths 51 and 52 are formed at both ends of the partition wall 41*a* in the axial directions of the stirring carrying members 53 and 54, and the developer can circulate between the two developer carrying paths 51 and 52 through these passages. In the exemplary embodiment, the stirring carrying member 53 located on the side close to the second developing roller 42B, out of the two stirring carrying members 53 and 54, is a member that mainly supplies the developer to the second developing roller 42B, and the other stirring carrying member 54 is a member that mainly stirs the developer and charges the developer to a desired amount of electric charge.

Further, a hole is formed in a portion of the developing container 41 at an obliquely downward location of the developer carrying path 52 located on the side far from the second developing roller 42B, and a permeability-type density sensor 55 that detects toner density in the developer by detecting a change in permeability is installed corresponding to this hole. Meanwhile, it goes without saying that the developer carrying path 52 is replenished with toner or is replenished with developer obtained by mixing toner and magnetic carrier, for example, using a replenishing mechanism which is not shown.

In the exemplary embodiment, particularly, the developing device 40 includes a developer division unit that divides developer on the second developing roller 42B regulated by the regulation member 45 into two parts for the developing rollers 42A and 42B at the opposite locations of the two developing rollers 42A and 42B and a developer carrying unit that carries the developer divided by the developer division unit toward each of the development areas DA and DB. Specifically, the first developing roller 42A and the second developing roller 42B are respectively provided with the dividing magnetic poles 61 (equivalent to the N3 pole of the first developing roller 42A and the S4 pole of the second developing roller 42B) having polarities different from each other, and the carrying magnetic poles 63 (equivalent to the S4 pole of the first developing roller 42A and the N3 pole of the second developing roller 42B) which are provided on the side located further downstream in the direction of rotation of the developing rollers 42A and 42B than the dividing magnetic poles 61 and have polarities different from those of the dividing magnetic poles 61.

In addition, the magnetic flux densities of the dividing magnetic poles 61 and the carrying magnetic poles 63 are as follows. Regarding the peak values of normal components of the magnetic flux densities of the dividing magnetic poles 61 (equivalent to the N3 pole of the first developing roller 42A and the S4 pole of the second developing roller 42B) and the carrying magnetic poles 63 (equivalent to the S4 pole of the first developing roller 42A and the N3 pole of the second developing roller 42B), the dividing magnetic poles 61 are smaller than the carrying magnetic poles 63 in a single developing roller, and the carrying magnetic poles 63 are smaller than the dividing magnetic poles 61 when two developing rollers are disposed opposite to each other. Further, the peak value of a normal component of the magnetic flux density of the magnetic poles has such a size that the developer is not delivered between the S4 pole of the first developing roller 42A and the N3 pole of the second developing roller 42B as the carrying magnetic poles 63. Meanwhile, the peak values of normal components of the magnetic flux densities of the dividing magnetic poles 61 and the carrying magnetic poles 63 in the first and second developing rollers 42A and 42B are substantially the same as each other.

<Operation of Image Forming Device>

As shown in FIG. 3, in the image forming device of the exemplary embodiment, a toner image formed on the photoreceptor 21 of each of four imaging devices 20 is sequentially transferred onto the intermediate transfer belt 30 at the primary transfer location which is an opposite location to the primary transfer roller 24, and a multiplexed toner image is formed on the intermediate transfer belt 30. The multiplexed toner image which is multiplexed on the intermediate transfer belt 30 is secondarily transferred onto the recording material P supplied from a recording material supply unit, not shown, at the secondary transfer location which is an opposite location to the secondary transfer roller 34. The recording material P onto which the toner image is transferred is transported to the fixing rollers 38 by way of the transport belt 37, and is fixed by the fixing rollers 38, and then is discharged by the discharge rollers 39 to, for example, a recording material receiving unit outside the device.

<Operation of Developing Device>

Figure 6:
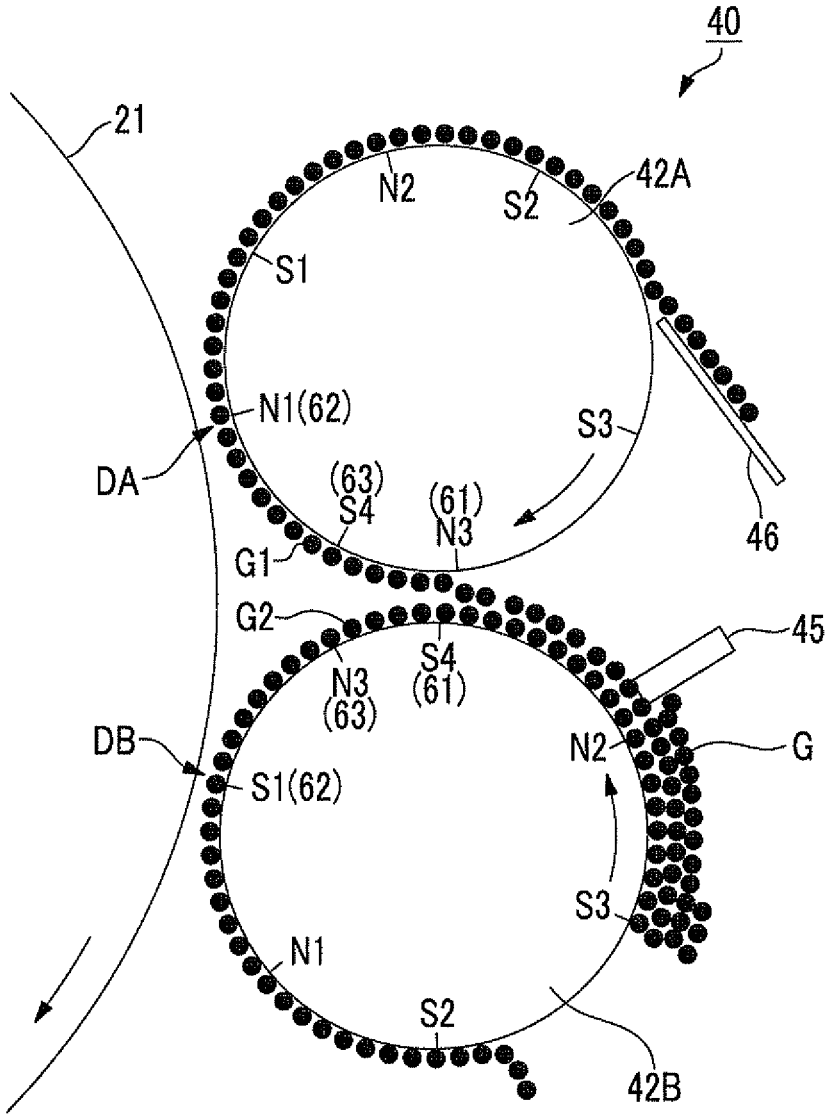
FIG. 6 is a diagram illustrating a movement of developer in the developing device according to Exemplary Embodiment 1.

FIG. 6 is a diagram illustrating a movement of the developer G centering on the first developing roller 42A and the second developing roller 42B, and operations in the developing device 40 will be described with reference to the drawing.

The developer G supplied onto the second developing roller 42B by the suction action of the S3 pole of the second developing roller 42B is sufficiently nipped between the N2 pole as a regulating magnetic pole and the regulation member 45, and the layer thickness of the developer G is regulated due to a gap between the nearest-neighbor locations of the regulation member 45 and the second developing roller 42B. A portion of the developer G on the second developing roller 42B regulated by the regulation member 45 moves from the second developing roller 42B side to the first developing roller 42A side by the suction action caused by a normal component of each magnetic flux density between two magnetic poles, that is, the pole as the dividing magnetic pole 61 on the second developing roller 42B side and the N3 pole as the dividing magnetic pole 61 on the first developing roller 42A side, and the residual thereof moves to the second developing roller 42B, and thus is divided into two parts. For this reason, the divided developer G is held on each of the developing rollers 42A and 42B. Hereinafter, in order to make it easier to understand, the developer on the first developing roller 42A after division is expressed as G1, and the developer on the second developing roller 42B after division is expressed as G2.

In the exemplary embodiment, since the S4 pole and the N3 pole as the carrying magnetic poles 63 are provided between the N3 pole of the first developing roller 42A and the S4 pole of the second developing roller 42B as the dividing magnetic poles 61, and the N1 pole of the first developing roller 42A and the S1 pole of the second developing roller 42B as the developing magnetic poles 62, as shown in FIGS. 2A and 25, the peeling off of the developer G1 and the developer G2 after division from the developing rollers 42A and 42B is suppressed, and the developer is carried toward each of the development areas DA and DB as it is. For this reason, the developer G1 and the developer G2 after division maintain the amount of developer corresponding to the division ratio of the developer division unit, and are carried toward each of the development areas DA and DB as developer layers having a small variation in layer thickness.

—With Respect to Developer Division Action of Developing Device According to Comparative Example—

First, a description will be made of magnetic patterns in an example in which the carrying magnetic poles 63 are not included as a comparative example, that is, the dividing magnetic poles 61 and the developing magnetic poles 62 are disposed next to each other. Meanwhile, the normal components of the magnetic flux densities of the dividing magnetic poles 61, the developing magnetic poles 62 and the carrying magnetic poles 63 in two developing rollers 42A and 42B are set to be the same as each other.

Figure 7B:
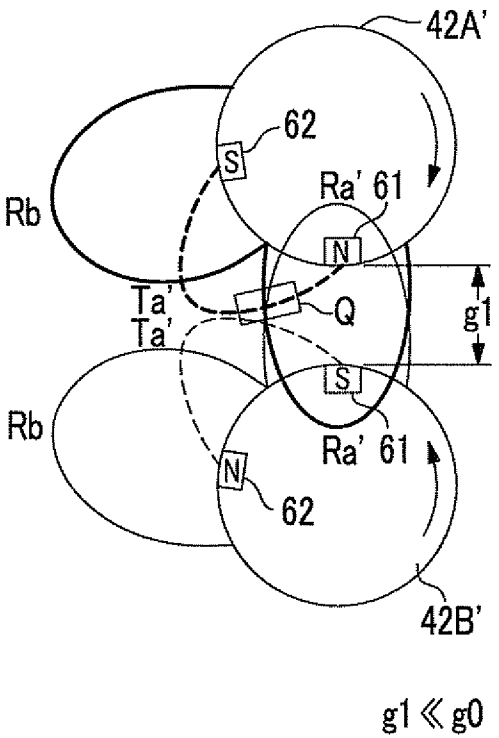
FIGS. 7A and 7B are diagrams illustrating magnetic patterns in a case where the carrying magnetic poles are not included as a comparative example.
Figure 7A:
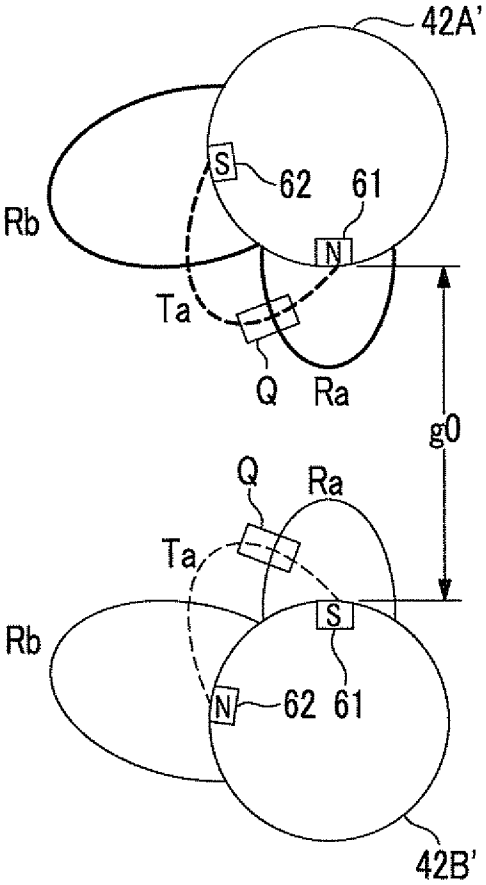

FIG. 7A is a diagram illustrating an example of a magnetic pattern in a state where the carrying magnetic pole 63 is not included, and two developing rollers 42A' and 42B' are separated by a distance (equivalent to g0 in the drawing) beyond a mutual magnetic action. Each of the developing rollers 42A' and 42B' shows the same magnetic pattern. Due to a normal component Ra of the magnetic flux density caused by the dividing magnetic pole 61 and a normal component Rb of the magnetic flux density caused by the developing magnetic pole 62, the peak value of a tangential component Ta of the magnetic flux density between both appears in substantially the center of two magnetic poles (dividing magnetic pole 61 and developing magnetic pole 62).

In order to dispose two developing rollers 42A' and 42B' to be opposite to each other and to divide the developer only using the heteropolar dividing magnetic poles 61, it is necessary to dispose two developing rollers 42A' and 42B' at positions close to each other and to exert a sufficient magnetic action. When the developing rollers 42A' and 42B' are brought close to each other (equivalent to g1 in the drawing: g1<<g0) to such an extent that the developer is divided due to the magnetic action of the dividing magnetic poles 61, a change in the magnetic pattern occurs as shown in FIG. 7B. That is, the heteropolar dividing magnetic poles 61 are disposed close to each other, so that the peak value of a normal component Ra' of the magnetic flux density caused by the dividing magnetic poles 61 becomes larger than that of the normal component Ra shown in FIG. 7A. Thereby, a tangential component Ta' of the magnetic flux density changes from the tangential component Ta shown in FIG. 7A, and the peak value thereof moves to the developing magnetic pole 62 side. For this reason, in the tangential component Ta', particularly, the size of the portion (portion indicated by Q in the drawing), shown in FIG. 7B, in which the normal components (Ra and Ra') of the dividing magnetic poles 61 start to decrease becomes smaller than that in FIG. 7A. Meanwhile, in FIG. 7B, the portion of Q on the developing roller 42B' side is omitted.

As stated above, when the tangential component of the magnetic flux density is small in a region in which the magnetic flux density in the normal direction is small between the dividing magnetic poles 61 and the developing magnetic poles 62, as shown in FIGS. 2A and 2B, the developer divided by the dividing magnetic poles 61 tends to be peeled off from the developing rollers 42A' and 42B' due to a decreasing constraining force acting on the developing rollers 42A' and 42B'. As stated above, when the developer is divided only due to the magnetic action of the dividing magnetic poles 61 in the division location (equivalent to the developer division unit), the two developing rollers 42A' and 42B' have to be disposed in close proximity to each other. Therefore, a carrying force acting on the developer after division decreases, and the carrying of the developer becomes unstable.

—With respect to Division Action of Developer of Developing Device According to Exemplary Embodiment—

Figure 8B:
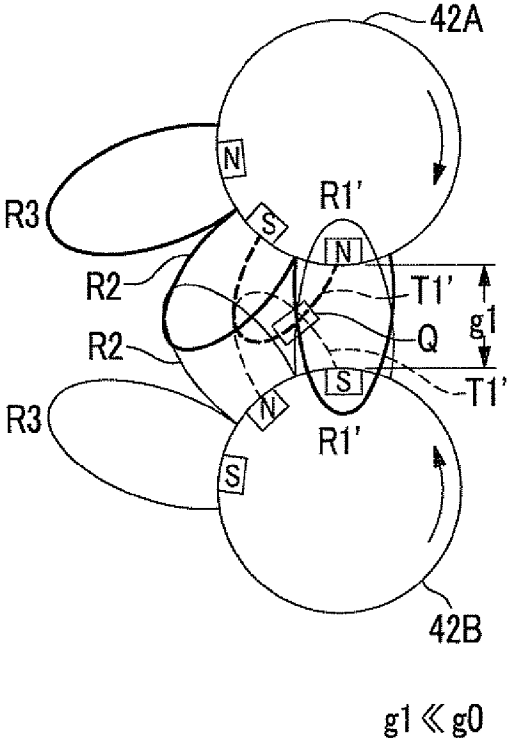
FIGS. 8A and 8B are diagrams illustrating magnetic patterns in a case where carrying magnetic poles are included as in Exemplary Embodiment 1.
Figure 8A:
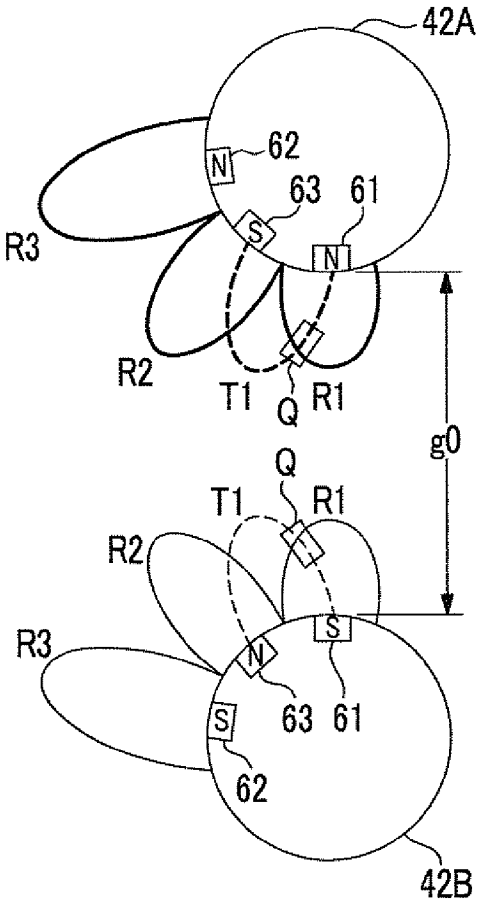

On the other hand, as in the exemplary embodiment, it is advantageous that the carrying magnetic pole 63 that increases a carrying force of the developer be included between the dividing magnetic pole 61 and the developing magnetic pole 62 (having a normal component R3 of magnetic flux density). FIGS. 8A and 8B are diagrams illustrating magnetic patterns when the carrying magnetic pole 63 is included between the dividing magnetic pole 61 and the developing magnetic pole 62 as in the exemplary embodiment; FIG. 8A is a diagram illustrating a state where two developing rollers 42A and 42B are separated by a distance (equivalent to g0 in the drawing) beyond a mutual magnetic action, and FIG. 8B is a diagram illustrating a state where these rollers are disposed in close proximity to each other (equivalent to g1 in the drawing: g1<<g0).

Similarly to FIGS. 7A and 7B, in FIG. 8A, due to the normal component R1 of the magnetic flux density caused by the dividing magnetic pole 61 and the normal component R2 of the magnetic flux density caused by the carrying magnetic pole 63, the peak value of a tangential component T1 of the magnetic flux density between both appears in substantially the center of two magnetic poles (dividing magnetic pole 61 and the carrying magnetic pole 63). However, when such developing rollers 42A and 42B are disposed in close proximity to each other, as shown in FIG. 8B, the peak value of the normal component R1' of the magnetic flux density of the dividing magnetic pole 61 considerably increases as compared to the case of FIG. 8A. Therefore, a tangential component T1' of the magnetic flux density between the dividing magnetic pole 61 and the carrying magnetic pole 63 also changes as compared to the case of FIG. 8A. In this case, the peak position of the tangential component T1' changes slightly toward the carrying magnetic pole 63. However, since the carrying magnetic pole 63 is located close to the dividing magnetic pole 61, this state is different from that of FIG. 7B in which the carrying magnetic pole 63 is not included. In addition, the peak value of the tangential component T1' slightly decreases as compared to FIG. 8A, but the size of the portion (portion indicated by Q in the drawing) in which the normal component R1 of the dividing magnetic pole 61 starts to decrease is secured to some extent. This shows that a tangential component having a larger size than that of the tangential component Ta' in the portion of Q shown in FIG. 7B is obtained. Meanwhile, in FIG. 8B, the portion of Q on the developing roller 42B side will be omitted.

Thereby, a sufficient carrying force is given to the developer immediately after division by providing the carrying magnetic poles 63, and the peeling off of the developer after division from each of the developing rollers 42A and 42B is suppressed, thereby allowing the developer having stable layer thickness to be carried toward each of the development areas DA and DB.

Figure 9A:
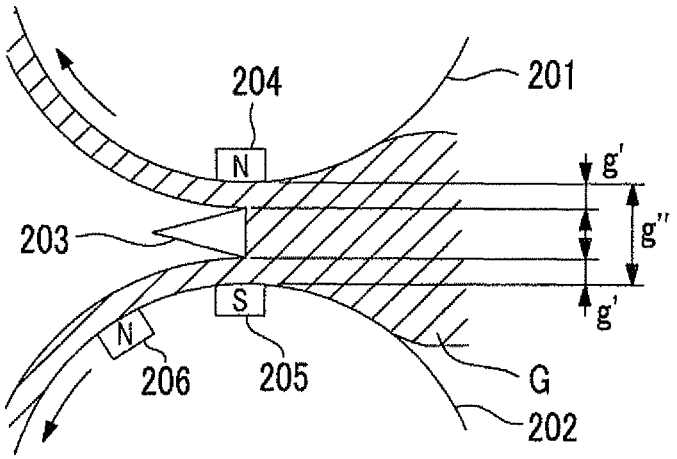
FIG. 9A is a schematic diagram illustrating a flow of developer in a case where a regulation member is included between two developing rollers as a comparative example.
Figure 9B:
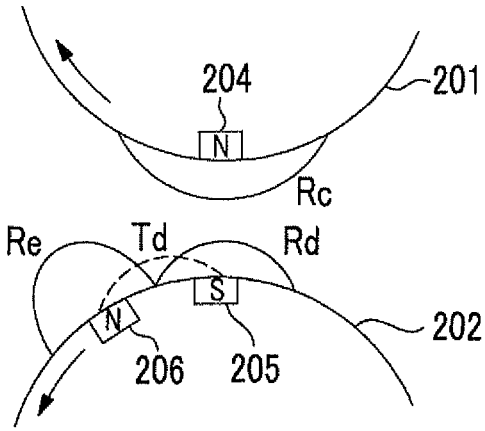
FIG. 9B is a diagram illustrating an example of a magnetic pattern thereof.

Incidentally, as in a comparative example shown in FIGS. 9A and 9B, a system is known in which two developing rollers 201 and 202 are disposed opposite to each other, and the developer G is divided into two parts for the two developing rollers 201 and 202 by providing a regulation member 203 in a gap g" between both. Here, FIG. 9A is a schematic diagram illustrating a flow of the developer G, and FIG. 9B is a diagram illustrating a magnetic pattern.

This is configured such that the developer G is supplied extending over two developing rollers 201 and 202 at the upstream side of the regulation member 203, and the layer thickness of the developer G is determined based on the regulation member 203 and a gap g' between the developing rollers 201 and 202. The developing rollers 201 and 202 are respectively provided with heteropolar magnetic poles 204 and 205 at positions opposite to the regulation member 203, and the developing roller 202 is provided with a magnetic pole 206 at the downstream side of the magnetic pole 205. In addition, gaps in such a configuration include a gap g' between the developing rollers 201 and 202 and the regulation member 203, and a gap g" between the developing rollers 201 and 202, and these gaps have a relationship of g'<g1<<g" in the exemplary embodiment (see FIG. 5).

In the comparative example, normal components Rc and Rd of magnetic flux densities of two magnetic poles 204 and 205 disposed opposite to the regulation member 203 do not have such a size that the magnetic poles 204 and 205 exert an interaction, and merely cause a magnetic action at the gap g' between the regulation member 203 and the magnetic poles. For this reason, the peak value of a tangential component Td of a magnetic flux density between the magnetic pole 205 and the magnetic pole 206 (normal component Re of a magnetic flux density) in the developing roller 202 is small. In such an example, since the retention of the developer G is caused to be generated at the upstream side of the regulation member 203, an extra load acts on the developer G. In addition, when the magnetic forces of the two magnetic poles 204 and 205 opposite to the regulation member 203 are attempted to be strengthened, the retention action of the developer G at the upstream side of the regulation member 203 is strengthened instead, which leads to an undesirable result.

—With Respect to Action When Dividing Magnetic Poles Are Caused to Be Biased—

Figure 10A:
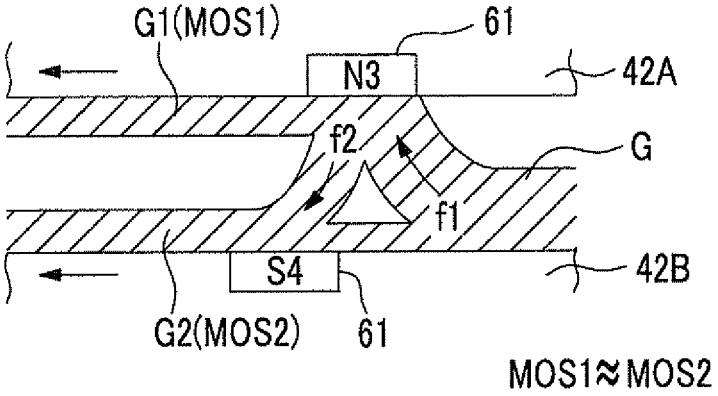
FIGS. 10A to 10C are diagrams illustrating an action based on the magnetic pole arrangement of dividing magnetic poles.
Figure 10B:
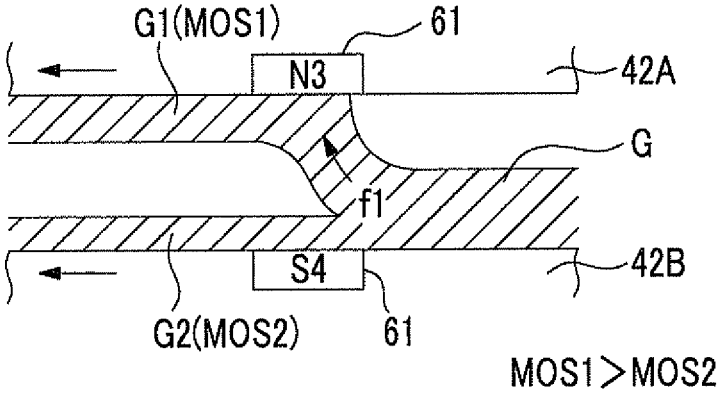
Figure 10C:
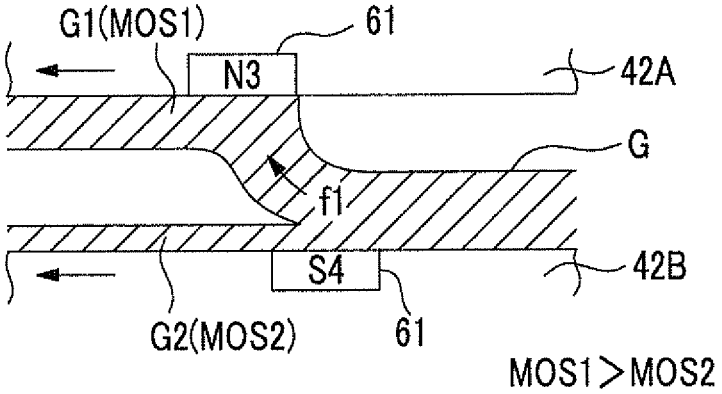

FIGS. 10A to 10C are diagrams illustrating influence on the developer G caused by the magnetic pole arrangement of the dividing magnetic poles 61; FIG. 10A is a diagram illustrating a state where the dividing magnetic pole 61 of the first developing roller 42A is biasedly disposed at the side located further upstream than the dividing magnetic pole 61 of the second developing roller 42B as in the exemplary embodiment, FIG. 10B is a diagram illustrating a state where the dividing magnetic poles 61 are disposed at opposite positions, and FIG. 10C is a diagram illustrating a state where the dividing magnetic pole 61 of the first developing roller 42A is biasedly disposed at the side located further downstream than the dividing magnetic pole 61 of the second developing roller 42B.

The flow of the developer G in such a state is thought to be as follows. Meanwhile, here, the peak values of the normal components of the magnetic flux densities of the dividing magnetic pole 61 of the first developing roller 42A and the dividing magnetic pole 61 of the second developing roller 42B are substantially the same as each other.

In the magnetic pole arrangement shown in FIG. 10A, the developer G carried on the second developing roller 42B is first suctioned by the dividing magnetic pole 61 of the first developing roller 42A, and a force f1 directed toward the first developing roller 42A side acts on a great deal of developer G. Thereafter, the developer G is substantially constrained in the meantime due to a suction action f2 of the dividing magnetic poles 61 (N3 pole and S4 pole), and the developer G is separated into both the developing rollers 42A and 42B by carrying forces of both the developing rollers 42A and 42B. For this reason, the developer G1 and the developer G2 on the first developing roller 42A and the second developing roller 42B after division tend to be divided equally. That is, the developer G moves to two places due to f1 and f2, so that the amount of developers (MOS1) attached to the first developing roller 42A and the amount of developers (MOS2) attached to the second developing roller 42B tend to be divided equally (MOS1≈MOS2). Meanwhile, when the peak values of the magnetic flux densities of the dividing magnetic poles 61 of two developing rollers 42A and 42B are caused to be different from each other, it goes without saying that the division ratio divided equally has a different value, and a great deal of developer G is divided onto the developing roller side having a large peak value.

In addition, in the magnetic pole arrangement shown in FIG. 10B, substantially equal magnetic forces act from both the first developing roller 42A and the second developing roller 42B due to both the dividing magnetic pole 61, and thus the developer G is nipped. Since the developer G is carried by the second developing roller 42B, the force f1 directed toward the first developing roller 42A side greatly acts in the opposite locations of two dividing magnetic poles 61, the developer G1 divided onto the first developing roller 42A rather tends to increase than the developer G2 on the second developing roller 42B. That is, a portion of the developer G on the second developing roller 42B is influenced by the force f1 directed toward the first developing roller 42A side at positions where two dividing magnetic poles 61 are opposite to each other, and thus the amount of developers (MOS1) attached to the first developing roller 42A tends to be larger than the amount of developers (MOS2) attached to the second developing roller 42B (MOS1>MOS2).

Further, in the magnetic pole arrangement shown in FIG. 10C, the developer G held and carried by the second developing roller 42B is continued to be carried in a state where the developer is suctioned by the dividing magnetic pole 61 of the second developing roller 42B, and then the influence of the magnetic force of the dividing magnetic pole 61 of the first developing roller 42A increases. Therefore, the developer G on the second developing roller 42B is suctioned, the force f1 directed toward the first developing roller 42A greatly acts, and the developer G is divided onto the first developing roller 42A. At this time, since much of the developer G on the second developing roller 42B is suctioned by the dividing magnetic pole 61 of the first developing roller 42A, the developer G1 on the first developing roller 42A rather tends to increase than the developer G2 on the second developing roller 42B. That is, the developer G is first divided at a position on which the dividing magnetic pole 61 of the first developing roller 42A acts, so that the force f1 directed toward the first developing roller 42A acts on a portion of the developer G. Therefore, the amount of developers (MOS1) attached to the first developing roller 42A tends to be larger than the amount of developers (MOS2) attached to the second developing roller 42B (MOS1>MOS2).

In all the states, since the carrying magnetic poles 63 are provided on the downstream side of the dividing magnetic poles 61, the peeling off of the developer G1 and the developer G2 after division from each of the developing rollers 42A and 42B is suppressed, and the developer is carried toward each of the development areas DA and DB in a stable state.

Further, in such a state, when the amount of developer G supplied to the opposite locations of the first developing roller 42A and the second developing roller 42B changes, that is, when the amount of developer G supplied by changing the speed of the developing roller, for example, in a case of different image sizes is caused to be different, the following estimation is made. Since the developer G moves to only one place (equivalent to f1) in FIGS. 10B and 10C, the amount of developer G divided depending on the amount of developer G supplied tends to be different, the division ratio tends to change. However, since the developer G moves to two places in FIG. 10A, the division ratio substantially divided equally is maintained even when the amount of developer G supplied changes. Hence, in the exemplary embodiment, the developer G1 and the developer G2 divided at the division ratio substantially divided equally are carried toward each of the development areas DA and DB.

In the exemplary embodiment, the developer G1 on the first developing roller 42A in the developer G divided in this manner is provided for use in development at the development area DA as shown in FIG. 6. Since the first developing roller 42A rotates in a different direction from that of the photoreceptor 21 at the opposite location, the developer G1 in the development area DA rather strongly hits against the photoreceptor 21, and thus has a feature of the scattering of magnetic carrier to the photoreceptor 21 side being suppressed.

The developer G1 which is held on the first developing roller 42A and passes through the development area DA is carried with the rotation of the first developing roller 42A, is peeled off from the first developing roller 42A due to a repulsion magnetic field between the S2 pole and the S3 pole, and is recovered to the developer carrying path 51 through the guide member 46 (see FIG. 4).

On the other hand, as shown in FIG. 6, the developer G2 on the second developing roller 42B after division is provided for use in development at the development area DB. Since the second developing roller 42B rotates in the same direction as that of the photoreceptor 21 at the opposite location, the developer G2 in the development area DB rather weakly hits against the photoreceptor 21, and thus has a feature that an obtained toner image is not likely to be disordered.

The developer G2 which is held on the second developing roller 42B and passes through the development area DB is carried with the rotation of the second developing roller 42B, is peeled off from the second developing roller 42B due to a repulsion magnetic field acting between the S2 pole and the S3 pole, and is recovered to the developer carrying path 51 side (see FIG. 4).

As shown in FIG. 4, the developer G1 and the developer G2 which are peeled off from the first developing roller 42A and the second developing roller 42B and are recovered to the developer carrying path 51 are stirred and carried by the stirring carrying members 53 and 54 while circulating through two developer carrying paths 51 and 52, and thus are provided for use in development again as the developer G having a desired amount of electric charge and density.

—With Respect to Magnetic Pole Width of Dividing Magnetic Pole and Carrying Magnetic Pole—

Figure 11A:
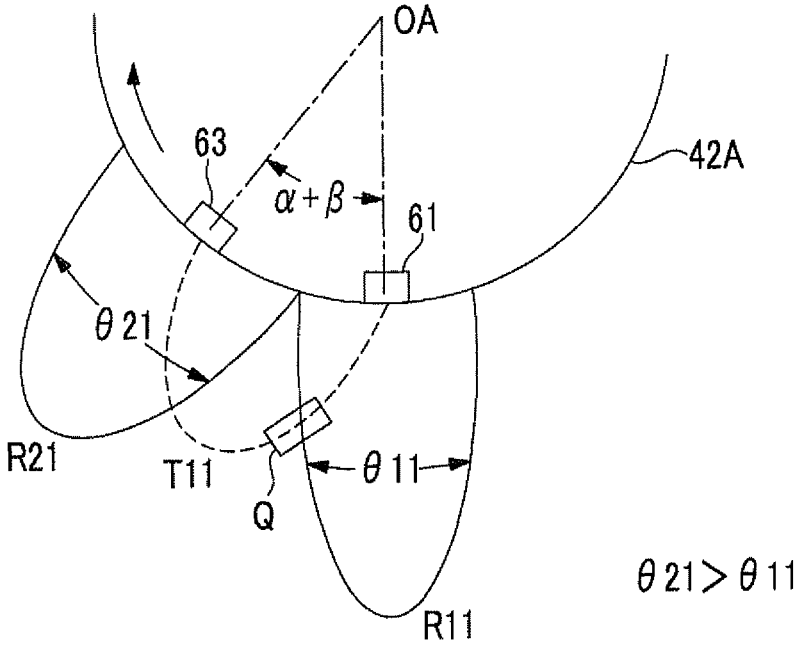
FIGS. 11A and 11B are diagrams illustrating actions based on the size of magnetic pole widths (half-value widths) of the dividing magnetic pole and the carrying magnetic pole.
Figure 11B:
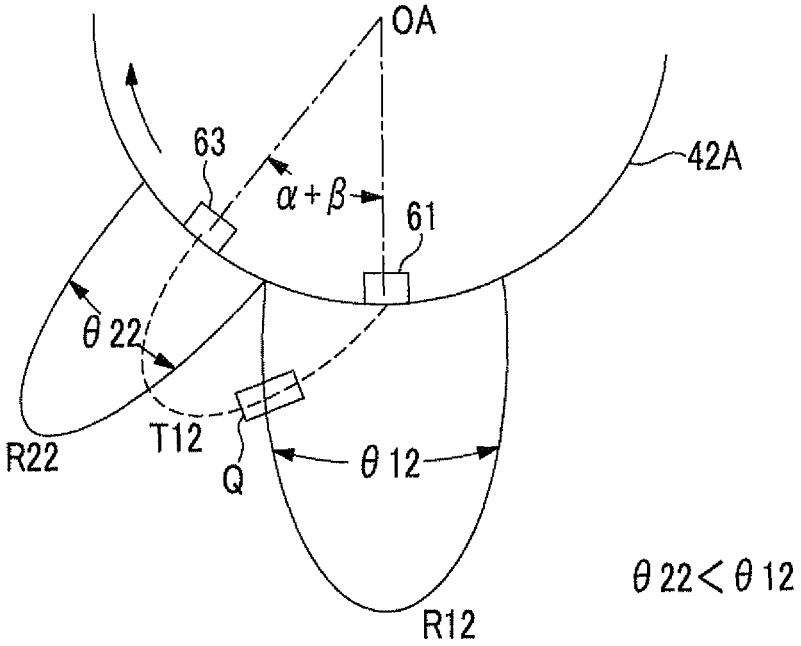

Next, the magnetic pole widths of the dividing magnetic pole 61 and the carrying magnetic pole 63 will be described. FIGS. 11A and 11B are diagrams illustrating magnetic patterns (states where R11, R12, R21 and R22 are normal components of magnetic flux densities and the second developing roller 42B, not shown, is disposed opposite thereto) of the first developing roller 42A when the dividing magnetic pole 61 and the carrying magnetic pole 63 having a different magnetic pole width (here, indicated by half-value width) are disposed at the same position; FIG. 11A is a diagram illustrating a case where a half-value width θ21 of the carrying magnetic pole 63 is larger than a half-value width θ11 of the dividing magnetic pole 61 (θ21>θ11), and FIG. 11B is a diagram illustrating a case where a half-value width θ22 of the carrying magnetic pole 63 is smaller than a magnetic pole width θ12 of the dividing magnetic pole 61 (θ22<θ12). Meanwhile, the angle between a line segment that links a central axis OA of the first developing roller 42A and a central position of the dividing magnetic pole 61 in the circumferential direction and a line segment that links the central axis OA and a central position of the carrying magnetic pole 63 in the circumferential direction is α+β (see FIG. 5).

A relationship between the flow of developer and the half-value width (equivalent to magnetic pole width) in such magnetic patterns is estimated as follows.

In FIG. 11A, the half-value width θ21 of the carrying magnetic pole 63 is caused to be larger than the half-value width θ11 of the dividing magnetic pole 61. Even when the peak of the tangential component T11 of the magnetic flux density between the dividing magnetic pole 61 and the carrying magnetic pole 63 comes close to the carrying magnetic pole 63 side, the size of the portion (portion indicated by Q in the drawing) in which the normal component of the dividing magnetic pole 61 starts to decrease is sufficiently secured. On the other hand, as shown in FIG. 11B, when the half-value width θ22 of the carrying magnetic pole 63 is caused to be smaller than the half-value width θ12 of the dividing magnetic pole 61, the size of the portion (portion indicated by Q in the drawing) in which the normal component of the dividing magnetic pole 61 starts to decrease becomes smaller than in FIG. 11A, to an extent that the peak of the tangential component T12 of the magnetic flux density between the dividing magnetic pole 61 and the carrying magnetic pole 63 is located at the carrying magnetic pole 63 side.

As a result, as shown in FIG. 11A, when the half-value width of the carrying magnetic pole 63 is caused to be larger than the half-value width of the dividing magnetic pole 61, the magnetic flux density immediately after division greatly secured, and thus the peeling off of the developer G from the developing roller 42A after division is further suppressed. Meanwhile, as shown in FIG. 11B, it goes without saying that the magnetic flux density immediately after division is secured to have a sufficient size as compared to a case where the carrying magnetic pole 63 is not provided.

Here, although the half-value widths of the carrying magnetic pole 63 and the dividing magnetic pole 61 are mentioned, the same is true of a case where instead of the half-value width, for example, an angle of occupation (equivalent to zero-point width) on the surfaces of the developing rollers 42A and 42B of the normal components of the magnetic flux densities, length in the circumferential direction of a magnet forming a magnetic pole, width having a predetermined ratio (for example, 80%) of the magnetic flux density to the peak value, and the like are indicated.

—With Respect to Layout of Carrying Magnetic Pole—

Figure 12A:
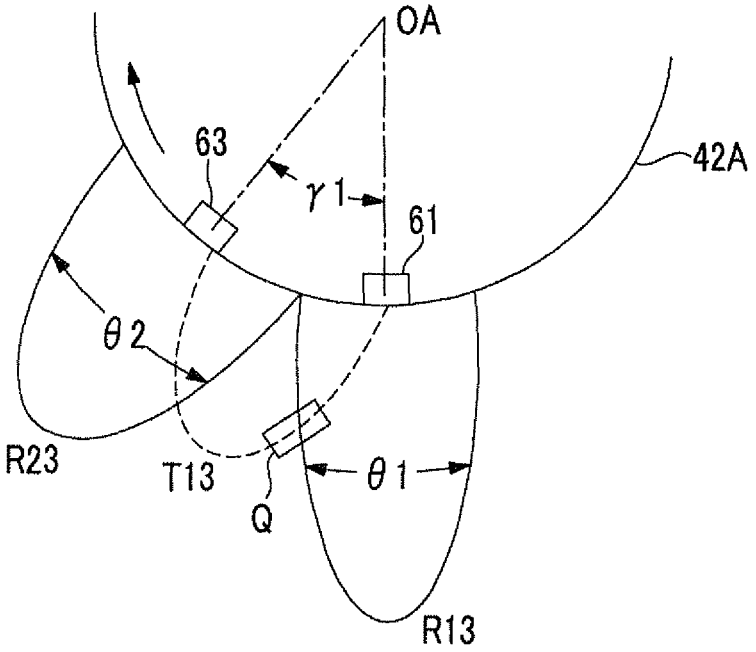
FIGS. 12A and 12B are diagrams illustrating actions in a case where the position of the carrying magnetic pole is changed, and are diagrams illustrating cases where the carrying magnetic pole shown in FIG. 12B is disposed at a position closer to the dividing magnetic pole than that shown in FIG. 12A.

Next, a layout of the carrying magnetic pole 63 for the dividing magnetic pole 61 will be described. FIGS. 12A and 128 are diagrams illustrating magnetic patterns on the first developing roller 42A side when the installation position of the carrying magnetic pole 63 is changed. Here, FIG. 12A is a diagram illustrating a case where the carrying magnetic pole is located approximately midway between the dividing magnetic pole 61 and the developing magnetic pole (not shown), and FIG. 128 is a diagram illustrating a case where the carrying magnetic pole 63 is disposed more slightly toward the dividing magnetic pole 61 than in FIG. 12A.

Figure 12B:
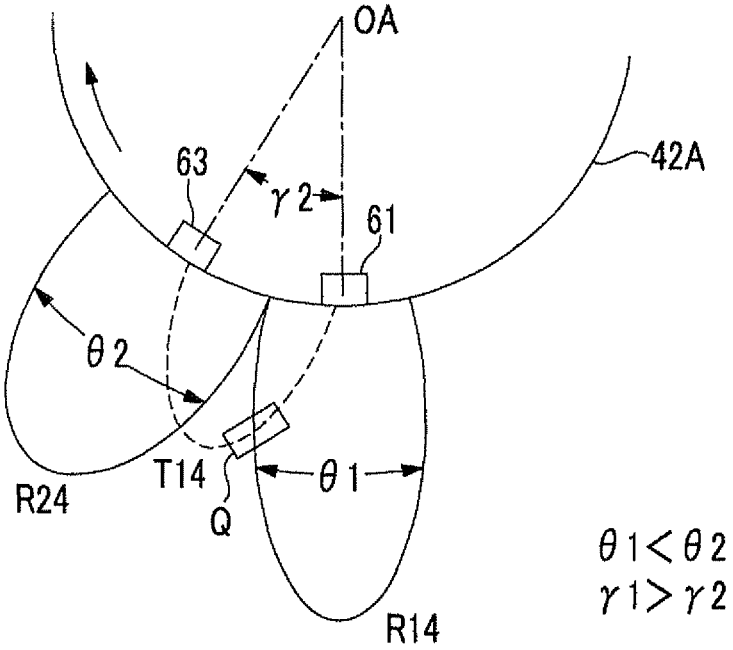

In this example, a half-value width θ1 of the dividing magnetic pole 61 and a half-value width θ2 of the carrying magnetic pole 63 are set substantially in the same manner in FIGS. 12A and 12B, and the half-value width θ1 of the dividing magnetic pole 61 is smaller than the half-value width θ2 of the carrying magnetic pole 63 (θ1<θ2). In addition, the angle between a line segment that links the central axis OA of the first developing roller 42A and the central position of the dividing magnetic pole 61 in the circumferential direction and a line segment that links the central axis OA and the central position of the carrying magnetic pole 63 in the circumferential direction is set to γ1 in FIG. 12A, and is set to γ2 in FIG. 12B (γ1>γ2).

In FIG. 12A, a tangential component T13 of the magnetic flux density occurs between the dividing magnetic pole 61 and the carrying magnetic pole 63, due to a normal component R13 of the magnetic flux density of the dividing magnetic pole 61 and a normal component R23 of the carrying magnetic pole 63. On the other hand, similarly in FIG. 12B, a tangential component T14 of the magnetic flux density occurs between the dividing magnetic pole 61 and the carrying magnetic pole 63, due to a normal component R14 of the magnetic flux density of the dividing magnetic pole 61 and a normal component R24 of the carrying magnetic pole 63. In both the tangential components T13 and T14, in a case where the carrying magnetic pole 63 is brought close to the dividing magnetic pole 61, the size of the tangential component in the portion (portion indicated by Q in the drawing) in which the normal component of the dividing magnetic pole 61 starts to decrease becomes large to an extent that the peak value of the tangential component comes close to the dividing magnetic pole 61. For this reason, the carrying property of the developer is more stable in the case in FIG. 12B.

In such magnetic pole arrangement, it is expected that a change occurs due to the size of the half-value width, for example, in a case where the magnetic pole is provided. However, when two developing rollers 42A and 423 are disposed opposite to each other, it is preferable to bring the carrying magnetic pole 63 close to the dividing magnetic pole 61 side within a range in which the mutual magnetic actions between the heteropolar carrying magnetic poles 63 do not influence each other. Thereby, in the tangential component of the magnetic flux density between the dividing magnetic pole 61 and the carrying magnetic pole 63, the inclination of a rise from the dividing magnetic pole 61 side increases, and thus the tangential component increases around the dividing magnetic pole 61 to that extent.

However, when the carrying magnetic pole 63 is brought excessively close to the dividing magnetic pole 61, an interaction between the carrying magnetic poles 63 arises, and the tangential component decreases to an extent that the normal component of the magnetic flux density of the carrying magnetic pole 63 increases. Thus, there is a concern that the developer is peeled off from the developing rollers 42A and 42B immediately after division. In addition, when the carrying magnetic pole 63 is taken too much away from the dividing magnetic pole 61, the inclination of a rise from the dividing magnetic pole 61 of the tangential component of the magnetic flux density tends to become gentle, and thus the tangential component in the portion in which the normal component of the dividing magnetic pole 61 starts to decrease becomes small. Hence, it is preferable to bring the carrying magnetic pole 63 close to the dividing magnetic pole 61 within a range beyond the mutual magnetic action between the carrying magnetic poles 63.

In the exemplary embodiment, although an example is shown in which the dividing magnetic poles 61 of the first developing roller 42A and the second developing roller 42B are biased toward the upstream side, for example, the dividing magnetic pole 61 on the second developing roller 42B side may be biased toward the downstream side. Further, the dividing magnetic pole 61 of the first developing roller 42A may be allowed to be biased toward the upstream side, and the dividing magnetic pole 61 of the second developing roller 42B may be allowed to be biased toward the downstream side.

Further, in the exemplary embodiment, although an example is shown in which the dividing magnetic pole 61 of the first developing roller 42A is biased toward the side located further upstream than the dividing magnetic pole 61 of the second developing roller 42B, both the dividing magnetic poles 61 may be disposed at positions opposite to each other, or the dividing magnetic pole 61 of the first developing roller 42A may be biased toward the side located further downstream than the dividing magnetic pole 61 of the second developing roller 42B. In the arrangement thereof, the division ratio is not easily divided equally, but it goes without saying that in any case, the carrying of the developer after division is stabilized by including the carrying magnetic pole 63.

In addition, in the exemplary embodiment, although an example is shown in which only the dividing magnetic pole 61 of the first developing roller 42A is biased toward the upstream side, the carrying magnetic pole 63 of the first developing roller 42A may be biased toward the upstream side with respect to the carrying magnetic pole 63 of the second developing roller 42B. Even when both the dividing magnetic pole 61 and the carrying magnetic pole 63 are biased, and the developer G suctioned to the first developing roller 42A side due to the dividing magnetic pole 61 of the first developing roller 42A is returned due to the magnetic action of the dividing magnetic pole 61 of the second developing roller 42B, the size of the tangential component of the magnetic flux density between the dividing magnetic pole 61 and the carrying magnetic pole 63, in the portion (for example, portion of Q in FIG. 8B) in which the normal component of the dividing magnetic pole 61 starts to decrease, is sufficiently secured at the first developing roller 42A side. Therefore, the amount of developer returned to the second developing roller 42B side is also reduced, and the division ratio substantially divided equally tends to be maintained.

In the exemplary embodiment, although an example is shown in which the photoreceptor 21 rotates (rotates in a clockwise direction in the drawing) in a downward direction in the drawing at an opposite location to the developing device 40, the photoreceptor 21 is also allowed to rotate in a counterclockwise direction in the drawing. In addition, in the exemplary embodiment, both the first developing roller 42A and the second developing roller 42B are configured such that plural V-shaped grooves are formed in the peripheral surfaces thereof. However, the peripheral surface capable of carrying the developer G may be provided, for example, a U-shaped or trapezoidal groove shape may be applied, and the peripheral surface having surface roughness which is set in advance by performing a blasting process using a selected blasting material may be used.

Exemplary Embodiment 2

Figure 13:
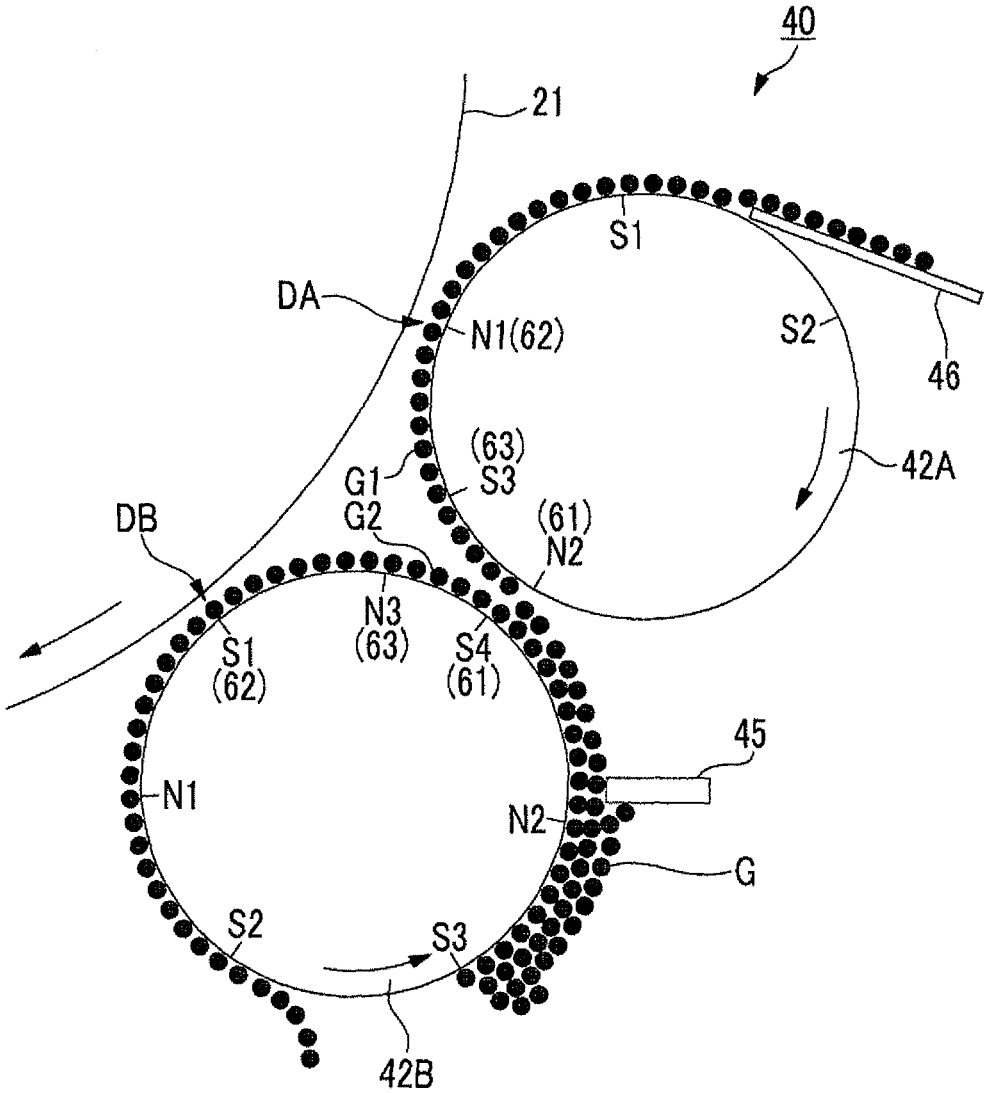
FIG. 13 is a diagram illustrating a movement of developer in a developing device of Exemplary Embodiment 2.

FIG. 13 is a partially enlarged view illustrating a developing device 40 of Exemplary Embodiment 2, and is a diagram illustrating a movement of developer G centering on a first developing roller 42A and a second developing roller 42B. The developing device 40 of the exemplary embodiment has substantially the same configuration as that in Exemplary Embodiment 1, but the number of magnetic poles of the first developing roller 42A is five unlike Exemplary Embodiment 1. Meanwhile, the same components as those in Exemplary Embodiment 1 are denoted by the same reference numerals and signs, and the detailed description thereof will be omitted herein.

In the exemplary embodiment, the first developing roller 422*k* is disposed at the side close to a developer carrying path, not shown, obliquely upward on the second developing roller 42B. For this reason, the magnetic pole arrangement within the second developing roller 42B is the same as that in Exemplary Embodiment 1, but the magnetic pole arrangement within the first developing roller 42A is different from that in Exemplary Embodiment 1. The first developing roller 42A is provided with five magnetic poles in the inside thereof. The N2 pole corresponding to a position opposite to the second developing roller 42B is the dividing magnetic pole 61, and the S3 pole is the carrying magnetic pole 63. In addition, the N1 pole is equivalent to the developing magnetic pole 62, the S1 pole is equivalent to a magnetic pole for peeling, and the S2 pole is equivalent to a magnetic pole that forms a repulsion magnetic field together with the S1 pole. Further, in the exemplary embodiment, similarly to Exemplary Embodiment 1, the dividing magnetic pole 61 (N2 pole) of the first developing roller 42A to which the developer G is not supplied is biasedly disposed at the side located further upstream than the dividing magnetic pole 61 (S4 pole) of the second developing roller 42B.

In such a configuration, the developer G supplied to the second developing roller 42B side is divided at an opposite location between the first developing roller 42A and the second developing roller 42B due to the magnetic action between the N2 pole of the first developing roller 42A and the S4 pole of the second developing roller 42B which are used as the dividing magnetic pole 61. The divided developer G1 on the first developing roller 42A is carried by the S3 pole as the carrying magnetic pole 63, and reaches a development area DA. The developer G1 developed in the development area DA is peeled off from the first developing roller 42A due to a repulsion magnetic field between the S1 pole and the S2 pole. The peeled developer G1 is recovered to a developer carrying path, not shown, through the guide member 96.

On the other hand, the divided developer G2 on the second developing roller 92B side is carried toward a development area DB by the S4 pole as the carrying magnetic pole 63. The developer G2 developed in the development area DB is peeled off from the second developing roller 42B due to a repulsion magnetic field between the S2 pole and the S3 pole and is recovered to the developer carrying path which is not shown.

In this manner, in the exemplary embodiment, since the first developing roller 42A is disposed obliquely upward on the second developing roller 42B, the peeling point at which the developer G1 is peeled off from the first developing roller 42A can be performed at a distant position on the side located further upstream in the direction of rotation of the first developing roller 42A than a location at which the dividing magnetic pole 61 (N2 pole) is disposed, and thus the number of magnetic poles can be reduced to that extent. The arrangement of the first developing roller 42A and the second developing roller 42B is not limited thereto, but, for example, the first developing roller 42A and the second developing roller 42B is allowed to be lined up substantially horizontally to each other, and even in this case, the number of magnetic poles of the first developing roller 42A can be reduced to less than seven.

Exemplary Embodiment 3

Figure 14:
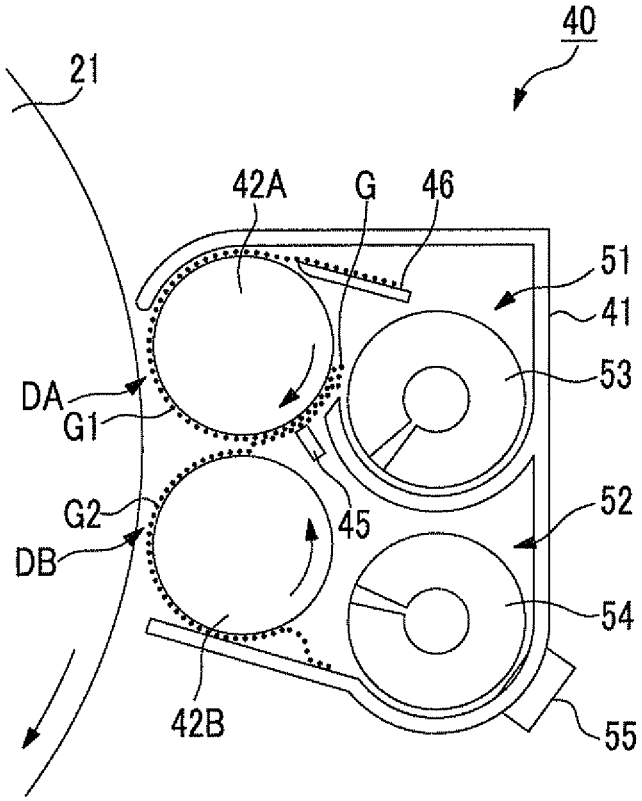
FIG. 14 is a schematic diagram illustrating an outline of a developing device of Exemplary Embodiment 3.

FIG. 14 is a schematic diagram illustrating an outline of a developing device 40 of Exemplary Embodiment 3. The developing device 40 of the exemplary embodiment is substantially the same as that in Exemplary Embodiment 1 with respect to the arrangement of the first developing roller 42A and the second developing roller 42B regarding the photoreceptor 21, but is different from that in Exemplary Embodiment 1, in that a roller to which the developer G is supplied is not the second developing roller 42B as in Exemplary Embodiment 1, but the first developing roller 42A disposed upward. Meanwhile, the same components as those in Exemplary Embodiment 1 are denoted by the same reference numerals and signs, and the detailed description thereof will be omitted herein.

In the developing device 40 of the exemplary embodiment, the regulation member 45 that regulates the layer thickness of the developer G is provided on the first developing roller 42A side. In addition, two developer carrying paths 51 and 52 lined up in the vertical direction in the drawing are provided behind the first and second developing rollers 42A and 42B in the developing container 41, and these developer carrying paths 51 and 52 are respectively provided with the stirring carrying members 53 and 54 that stir and carry the developer G. A passage through which the developer G is able to pass between the upper and lower developer carrying paths 51 and 52 is formed on both ends of the two developer carrying paths 51 and 52 in the longitudinal direction, and is configured, for example, such that the developer G in the lower developer carrying path 52 can reach the upper developer carrying path 51 side through the rotation of the lower stirring carrying member 54. In addition, the permeability-type density sensor 55 is installed on an obliquely downward location of the lower developer carrying path 52, and is configured such that the toner density of the developer G in the lower developer carrying path 52 is measured. Meanwhile, reference numeral 46 is a guide member that guides the developer G peeled off from the first developing roller 42A to the developer carrying path 51.

Figure 15:
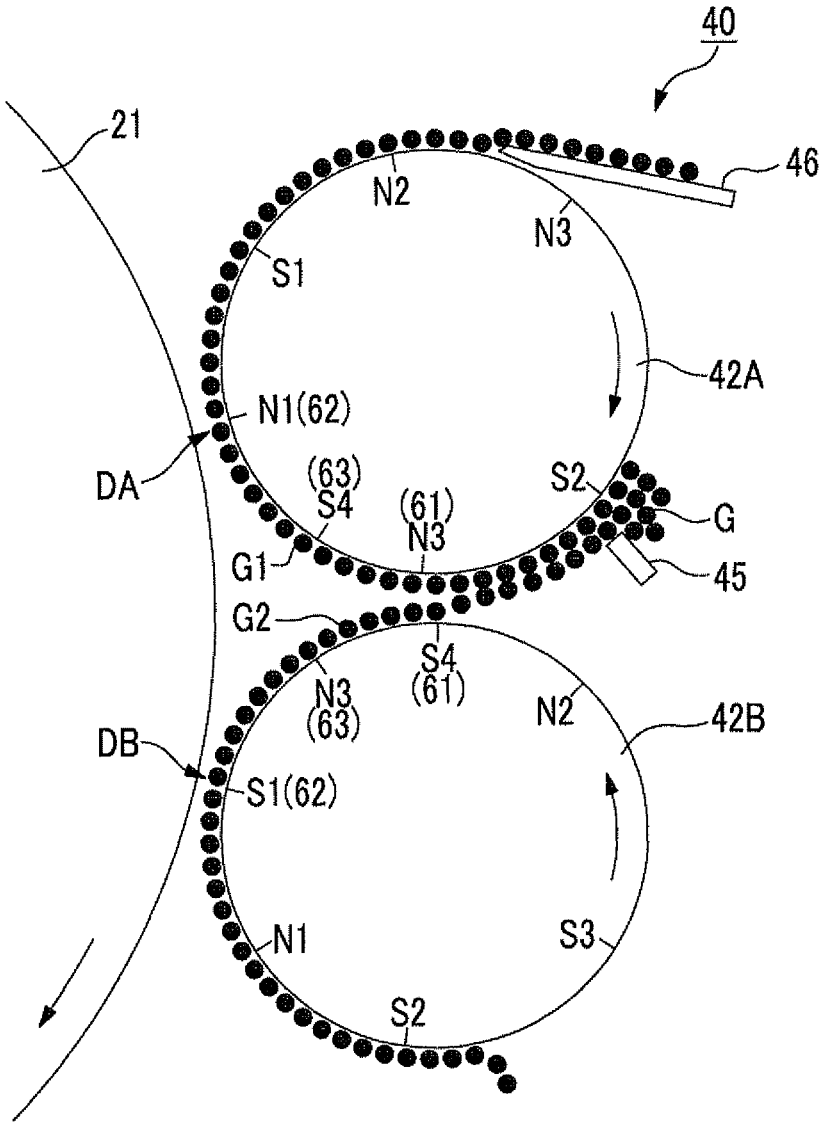
FIG. 15 is a diagram illustrating a movement of developer in the developing device of Exemplary Embodiment 3.

In addition, FIG. 15 is a partially enlarged view illustrating the developing device 40 of the exemplary embodiment, and is a diagram illustrating a movement of the developer G centering on the first developing roller 42A and the second developing roller 42B. In the magnetic pole arrangement of the exemplary embodiment, the dividing magnetic pole 61 (S4 pole) of the second developing roller 42B which is a developing roller located at the side different from the side to which the developer G is supplied is biasedly disposed at the side located further upstream than the dividing magnetic pole 61 (N3 pole) of the first developing roller 42A which is a developing roller to which the developer G is supplied.

Operations of the developing device 40 having such a configuration will be described with reference to FIGS. 14 and 15.

In the exemplary embodiment, the developer G having a desired amount of electric charge obtained by stirring in two stirring carrying members 53 and 54 is supplied toward the S2 pole of the first developing roller 42A with the rotation of the upper stirring carrying member 53. The layer thickness of the developer G supplied onto the first developing roller 42A is regulated by the regulation member 45. In the opposite location between the first developing roller 42A and the second developing roller 42B, the developer G held on the first developing roller 42A is divided onto the first developing roller 42A side and the second developing roller 42B side, due to the magnetic action between the N3 pole of the first developing roller 42A and the S4 pole of the second developing roller 42B which are used as the dividing magnetic pole 61.

The developer G1 out of the divided the developer G1 and developer G2 on the first developing roller 42A side is carried toward the development area DA by the S4 pole as the carrying magnetic pole 63. The developer G1 provided for use in development in the development area DA is carried with the rotation of the first developing roller 42A, and is peeled off from the first developing roller 42A due to the action of a repulsion magnetic field between the N2 pole and the N3 pole. The developer G1 peeled off from the first developing roller 42A is recovered to the developer carrying path 51 by way of the guide member 46.

On the other hand, the developer G2 out of the divided developer G1 and the developer G2 on the second developing roller 42B side is carried toward the development area DB by the N3 pole as the carrying magnetic pole 63. The developer G2 provided for use in development in the development area DB is carried with the rotation of the second developing roller 42B, and is peeled off from the second developing roller 42B by the action of a repulsion magnetic field between the S2 pole and the S3 pole. The developer G2 peeled off from the second developing roller 42B is recovered to the lower developer carrying path 52 side as it is.

Particularly, in the exemplary embodiment, the dividing magnetic pole 61 of the second developing roller 42B which is a developing roller to which the developer G is not supplied is biasedly disposed at the side located further upstream than the dividing magnetic pole 61 of the first developing roller 42A which is a developing roller to which the developer G is supplied. Therefore, similarly to Exemplary Embodiment 1, the developer G1 and the developer G2 supplied to the development area DA and the development area DB tend to be divided at a division ratio substantially divided equally, and a variation in the layer thickness of the developer G1 and the developer G2 after division is also suppressed, thereby allowing an improvement in the uniformity of image quality to be achieved. Meanwhile, in the exemplary embodiment, the direction of rotation of the photoreceptor 21 is also allowed to be set to a reverse direction to the drawing (counterclockwise direction in the drawing).

Exemplary Embodiment 4

Figure 16:
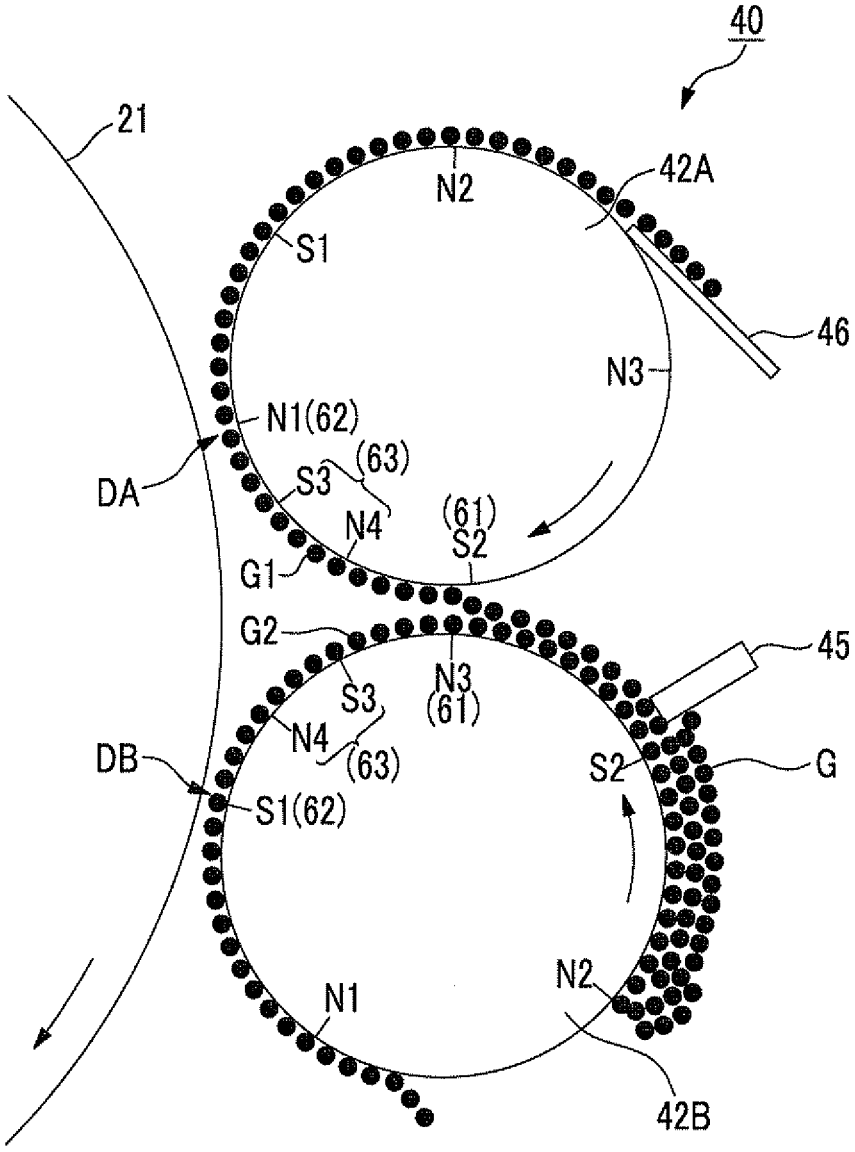
FIG. 16 is a diagram illustrating a movement of developer in a developing device of Exemplary Embodiment 4.

FIG. 16 is a partially enlarged view illustrating a developing device 90 of Exemplary Embodiment 4, and is a diagram illustrating a movement of developer G centering on the first developing roller 42A and the second developing roller 42B. The developing device 40 of the exemplary embodiment has substantially the same configuration as that in Exemplary Embodiment 1, but the numbers of carrying magnetic poles 63 of the first developing roller 42A and the second developing roller 42B are two, respectively, unlike Exemplary Embodiment 1. Meanwhile, the same components as those in Exemplary Embodiment 1 are denoted by the same reference numerals and signs, and the detailed description thereof will be omitted herein.

As magnetic poles within the first developing roller 42A of the exemplary embodiment, an N1 pole, an S1 pole, an N2 pole, an N3 pole, an S2 pole, an N4 pole, and an S3 pole are provided. The N1 pole is the developing magnetic pole 62, the S2 pole is the dividing magnetic pole 61, and the N4 pole and the S3 pole are the carrying magnetic poles 63. On the other hand, as magnetic poles within the second developing roller 42B, an S1 pole, an N1 pole, an N2 pole, an S2 pole, an N3 pole, an S3 pole, and an N4 pole are provided. The S1 pole is the developing magnetic pole 62, the N3 pole is the dividing magnetic pole 61, and the S3 pole and the N4 pole are the carrying magnetic poles 63. In the exemplary embodiment, the dividing magnetic pole 61 (S2 pole) of the first developing roller 42A which is a developing roller to which the developer G is not supplied is biasedly disposed at the side located further upstream than the dividing magnetic pole 61 (N3 pole) of the second developing roller 42B which is a developing roller to which the developer G is supplied.

In such a configuration, the developer G supplied to the second developing roller 42B side is divided at the opposite location between the first developing roller 42A and the second developing roller 42B, due to the magnetic action between the S2 pole of the first developing roller 42A and the N3 pole of the second developing roller 42B which are used as the dividing magnetic pole 61. The divided developer G1 on the first developing roller 42A is carried by the N4 pole and the S3 pole as the carrying magnetic pole 63, and reaches the development area DA. The developer G1 developed in the development area DA is peeled off from the first developing roller 42A due to a repulsion magnetic field between the N2 pole and the N3 pole. The peeled developer G1 is recovered to a developer carrying path, not shown, through the guide member 46.

On the other hand, the divided developer G2 on the second developing roller 42B side is carried toward the development area DB by the S3 pole and the N4 pole as the carrying magnetic pole 63. The developer G2 developed in the development area DB is peeled off from the second developing roller 42B due to a repulsion magnetic field between the N1 pole and the N2 pole and recovered to the developer carrying path which is not shown.

In the exemplary embodiment, an example is shown in which two magnetic poles are used as the carrying magnetic pole 63 in both the first developing roller 42A and the second developing roller 42B, but, for example, the carrying magnetic pole 63 on one developing roller side may be used as one magnetic pole without being limited thereto, and three or more magnetic poles are allowed to be included as the carrying magnetic pole 63. In addition, when plural magnetic poles are included as the carrying magnetic pole 63, when the widths of these magnetic poles are caused to be different from each other, and, for example, the width of the magnetic pole close to the dividing magnetic pole 61 is caused to increase, the tangential component of the magnetic flux density after division is sufficiently secured.

Meanwhile, in the example in which two developing rollers 42A and 42B are disposed opposite to each other with respect to the photoreceptor 21, the angle from the dividing magnetic pole 61 to the developing magnetic pole 62, that is, the angle between a line segment that links the central position of the magnetic pole width along the circumferential direction of the dividing magnetic pole 61 and the rotation center of each of the developing rollers 42A and 42B and a line segment that links the central position of the magnetic pole width along the circumferential direction of the developing magnetic pole 62 and the rotation center of each of the developing rollers 42A and 42B is generally less than 90 degrees. For this reason, a sufficient magnetic pole width is obtained in the carrying magnetic pole 63. In addition, in order to simplify the configuration, it is preferable to adopt one magnetic pole as the carrying magnetic pole 63.

Exemplary Embodiment 5

Figure 17:
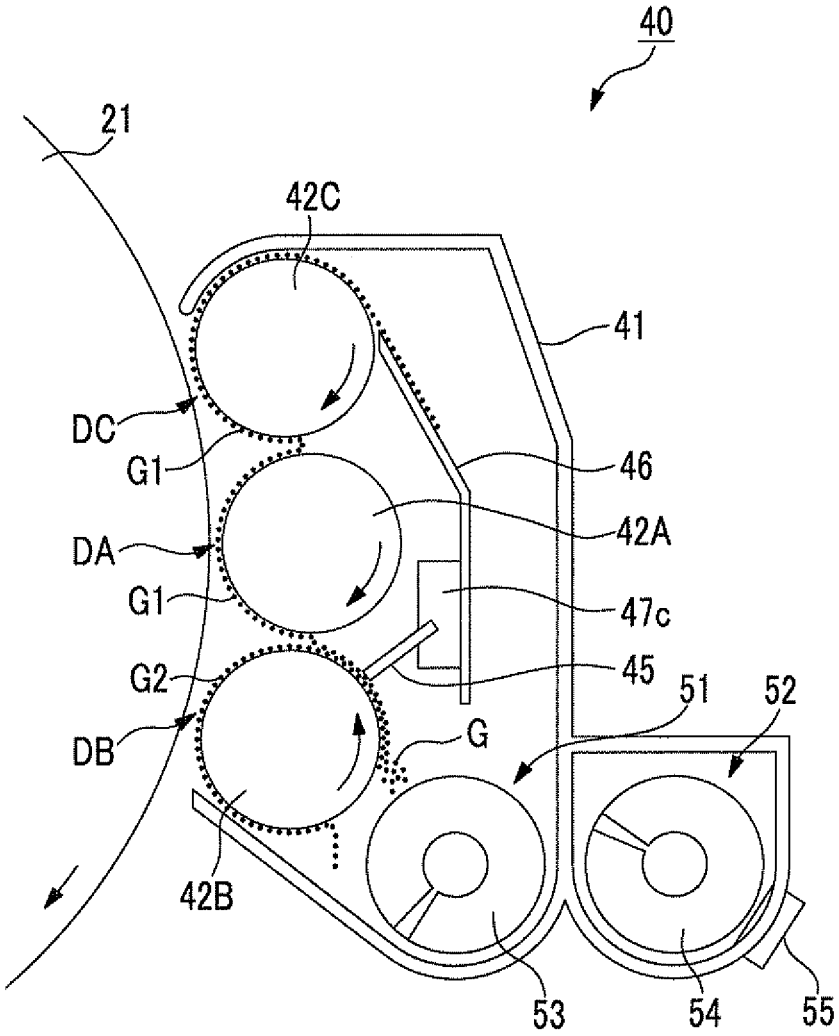
FIG. 17 is a schematic diagram illustrating an outline of a developing device of Exemplary Embodiment 5.

FIG. 17 is a schematic diagram illustrating an outline of a developing device 40 of Exemplary Embodiment 5. The developer device 40 of the exemplary embodiment is characterized in that three developing rollers 42A to 42C are included with respect to the photoreceptor 21. The arrangement of the first developing roller 42A and the second developing roller 42B are substantially the same as that in Exemplary Embodiment 1, but the developing device 40 is different from the developing device 40 of Exemplary Embodiment 1, in that a third developing roller 42C is provided as an additional developing roller at the side located further upstream in the direction of rotation of the photoreceptor 21 than the first developing roller 42A. Meanwhile, the same components as those in Exemplary Embodiment 1 are denoted by the same reference numerals and signs, and the detailed description thereof will be omitted herein.

In the developing device 40 of the exemplary embodiment, three developing rollers of the third developing roller 42C, the first developing roller 42A, and the second developing roller 42B are disposed side by side from the upstream side along the direction of rotation of the photoreceptor 21. The first developing roller 42A and the second developing roller 42B rotate similarly to Exemplary Embodiment 1, and the third developing roller 42C rotates in the same direction as the first developing roller 42A. That is, in the opposite location to the photoreceptor 21, the first developing roller 42A and the third developing roller 42C rotate in a reverse direction to that of the photoreceptor 21, and the second developing roller 42B rotates in the same direction as the photoreceptor 21. In the exemplary embodiment, in the opposite location between the first developing roller 42A and the third developing roller 42C, the developer G1 on the first developing roller 42A is delivered to the third developing roller 42C side.

In the exemplary embodiment, the regulation member 45 supported by a resin block 47*c* within the developing container 41 is disposed opposite to the second developing roller 42B. In addition, the guide member 46 extending downward is supported behind the third developing roller 42C by the resin block 47*c*. Meanwhile, it goes without saying that each developing bias is supplied between the three developing rollers 42A, 42B, and 42C and the photoreceptor 21.

Figure 18:
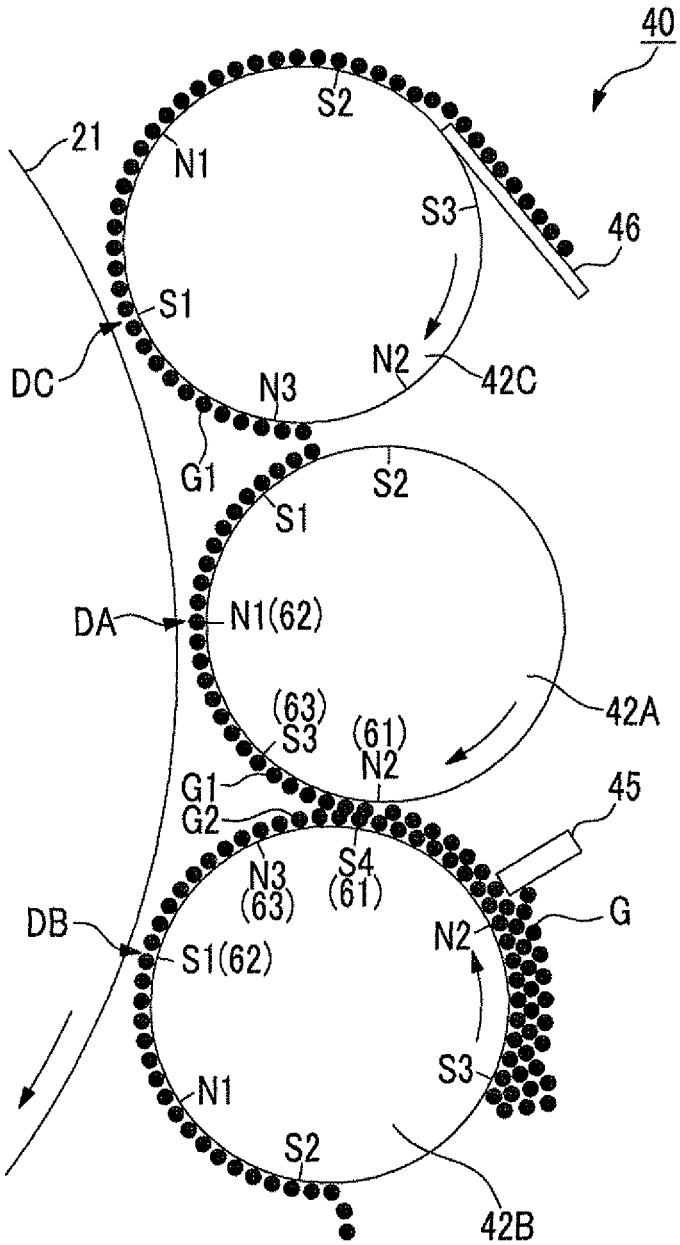
FIG. 18 is a diagram illustrating a movement of developer in a developing device of Exemplary Embodiment 5.

FIG. 18 is a diagram illustrating an example of the magnetic pole arrangement within the first developing roller 42A, the second developing roller 428 and the third developing roller 42C in the exemplary embodiment, and is a diagram illustrating a flow of developer.

The first developing roller 42A is provided with an N1 pole as the developing magnetic pole 62, an S1 pole and an S2 pole for peeling off the developer G1, an N2 pole as the dividing magnetic pole 61, and an S3 pole as the carrying magnetic pole 63. In addition, the third developing roller 42C is provided with an S1 pole and N1 pole which are used as the developing magnetic pole 62, an S3 pole for generating a repulsion magnetic field between the S3 pole and an S2 pole, and an N2 pole and an N3 pole which are provided corresponding to the S1 pole and the S2 pole of the first developing roller 42A. In addition, in the exemplary embodiment, the dividing magnetic pole 61 (N2 pole) of the first developing roller 42A is also biasedly disposed at the side located further upstream in the direction of rotation of the first developing roller 42A than the dividing magnetic pole 61 (S4 pole) of the second developing roller 42B. Meanwhile, the magnetic pole arrangement of the second developing roller 42B is the same as that in Exemplary Embodiment 1, and thus the description thereof will be omitted. In addition, in the exemplary embodiment, the circumferential speed of the first developing roller 42A and the circumferential speed of the third developing roller 42C are substantially the same as each other.

Operations of the developing device 40 having such a configuration will be described with reference to FIGS. 17 and 18.

In the exemplary embodiment, the developer G having a desired amount of electric charge obtained by stirring in two stirring carrying members 53 and 54 is supplied to the vicinity of the S3 pole of the second developing roller 42B with the rotation of the stirring carrying member 53. The layer thickness of the developer G supplied onto the second developing roller 42B is regulated by the N2 pole as a regulating magnetic pole and the regulation member 45. In the opposite location between the first developing roller 42A and the second developing roller 42B, the developer G of the layer thickness is regulated is divided due to the magnetic action between the N2 pole of the first developing roller 42A and the S4 pole of the second developing roller 42B which are used as the dividing magnetic pole 61, and thus the developer G held on the second developing roller 42B is divided onto the first developing roller 42A side and the second developing roller 42B side.

The developer G1 out of the developer G1 and the developer G2 after division on the first developing roller 42A is carried toward the development area DA by the carrying magnetic pole 63 (S3 pole) in a state where a division ratio is maintained. The developer G1 by which development is completed in the development area DA is carried with the rotation of the first developing roller 42A. The developer G1 carried onto the first developing roller 42A is peeled off from the first developing roller 42A due to the magnetic action between the S1 pole and the S2 pole forming a repulsion magnetic field. At this time, since the third developing roller 42C is provided with the N3 pole and the N2 pole having a polarity different from that of the 31 pole and the 32 pole, corresponding to the S1 pole and the S2 pole of the first developing roller 42A, the developer G1 peeled off from the first developing roller 42A is delivered to the third developing roller 42C side as it is. That is, in the exemplary embodiment, the magnetic action between the S1 pole and the S2 pole provided on the first developing roller 42A and the N3 pole and the N2 pole provided on the third developing roller 42C is equivalent to that in the delivery unit. Meanwhile, the delivery unit is allowed to be other than a system using the above-mentioned repulsion magnetic field, and a well-known system may be adopted.

The developer G1 delivered to the third developing roller 42C is developed in a development area DC, and is carried with the rotation of the third developing roller 42C. Thereafter, the developer G is peeled off from the third developing roller 42C due to the magnetic action between the S2 pole and the S3 pole forming a repulsion magnetic field. The developer G1 peeled off from the third developing roller 42C is recovered to the developer carrying path 51 side by way of the guide member 46.

On the other hand, the developer G2 out of the divided developer G1 and the developer G2 on the second developing roller 42B side is carried toward the development area DB by the carrying magnetic pole 63 (N3 pole). The developer G2 by which development is completed in the development area DB is carried with the rotation of the second developing roller 42B, and is peeled off from the second developing roller 42B due to the magnetic action between the S2 pole and the S3 pole forming a repulsion magnetic field. The developer G2 peeled off from the second developing roller 42B is recovered to the developer carrying path 51 side.

As stated above, in the exemplary embodiment, since development is repeatedly with respect to the electrostatic latent image on the photoreceptor 21, in three development areas (DC, DA, and DB in order) of the development area DC in the third developing roller 42C, the development area DA in the first developing roller 42A, and the development area DB in the second developing roller 42B, development efficiency for the electrostatic latent image on the photoreceptor 21 is further improved than in a case where the third developing roller 42C is not included. Further, since the first developing roller 42A and the second developing roller 42B are provided with the carrying magnetic poles 63 (equivalent to the S3 pole of the first developing roller 42A and the N3 pole of the second developing roller 42B) after division, the developer G1 and the developer G2 in which the variation of layer thickness is suppressed are carried to each development area in a state where a division ratio is stable.

In the exemplary embodiment, an example is shown in which the direction of rotation of the photoreceptor 21 is set to a clockwise direction in the drawing, however, the photoreceptor 21 may be set to a reverse direction thereto (counterclockwise direction in the drawing). In this case, in the drawing, the second developing roller 42B rotates in a reverse direction to that of the photoreceptor 21 in the opposite location to the photoreceptor 21, and the first developing roller 42A and the third developing roller 42C rotate in the same direction as the photoreceptor 21 in the opposite location to the photoreceptor 21. Even when such a configuration is adopted, the number of development areas formed along with the photoreceptor 21 is three, and thus development efficiency is further improved than in a case where the third developing roller 42C is not included.

Here, although an example is shown in which the third developing roller 42C is provided with respect to the first developing roller 42A, the third developing roller 42C may be provided on the second developing roller 42B side, and an additional developing roller may be provided on the first developing roller 42A and the second developing roller 42B.

EXAMPLE

Example 1

In the present example, in order to confirm the usefulness of the carrying magnetic poles in the first developing roller 42A and the second developing roller 42B, magnetic patterns are shown in which seven magnetic poles are included in the insides thereof. Meanwhile, for the purpose of comparison, magnetic patterns of five-pole configurations (first developing roller 42A' and second developing roller 42B') having no magnetic pole equivalent to the carrying magnetic pole are also shown.

Figure 19:
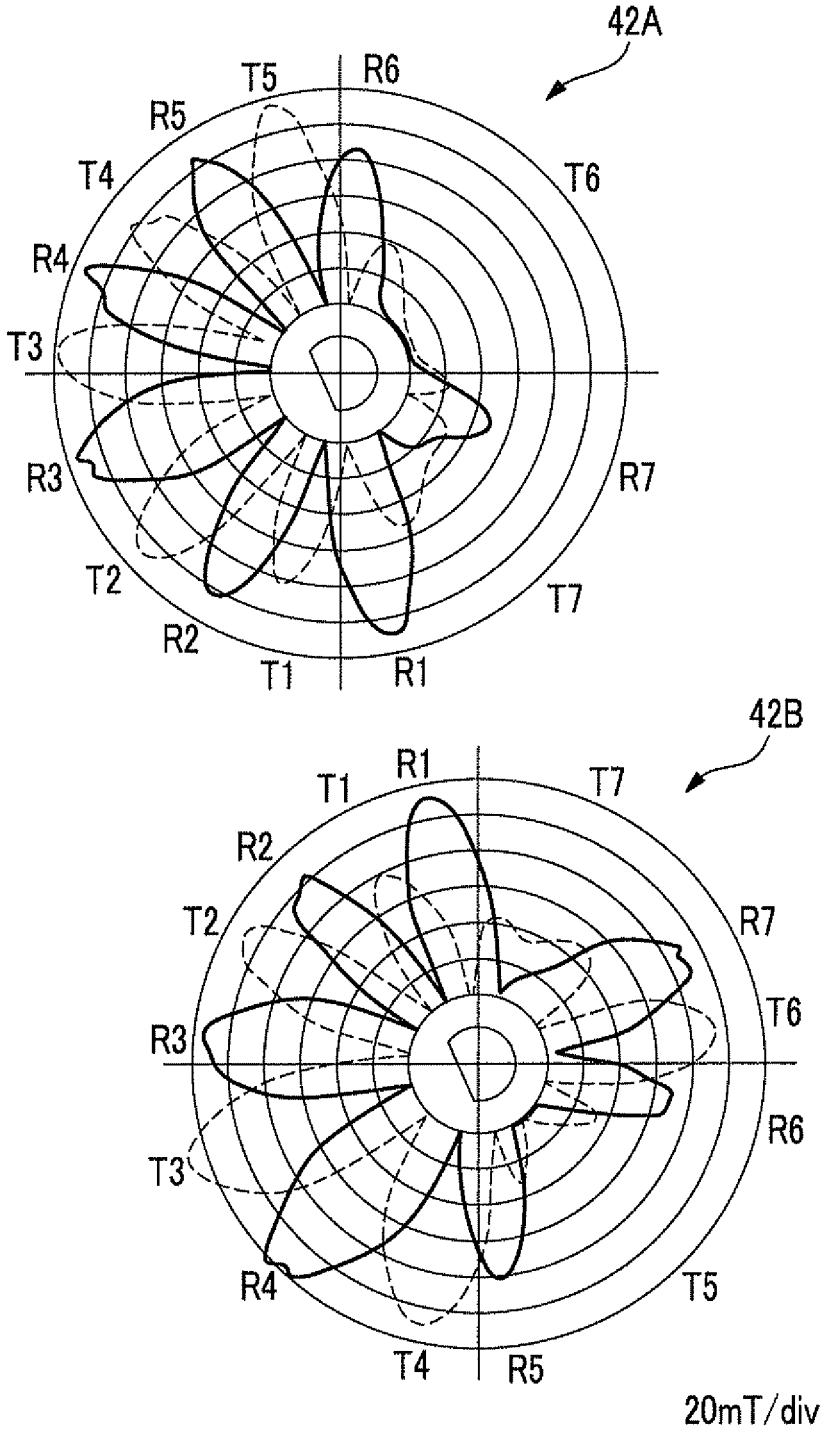
FIG. 19 is a diagram illustrating an example of magnetic patterns when seven-pole developing rollers of Example 1 are disposed opposite to each other.

FIG. 19 is a diagram illustrating magnetic patterns in the present example. Here, solid lines denote normal components (equivalent to R1 to R7) of magnetic flux densities, and dotted lines denote tangential components (equivalent to T1 to T7) of magnetic flux densities. Here, the magnetic flux density in the simplex of two developing rollers 42A and 42B is set to 90 mT in the dividing magnetic pole (magnetic pole equivalent to R1 in the drawing), and is set to 100 mT in the carrying magnetic pole (magnetic pole equivalent to R2 in the drawing). However, even when the magnetic poles having such magnetic flux densities are disposed, the magnetic poles are disposed opposite to each other. Therefore, the normal component (equivalent to R1 in the drawing) of the magnetic flux density at an observed position of the dividing magnetic pole becomes larger than the normal component (equivalent to R2 in the drawing) of the magnetic flux density at a position of the carrying magnetic pole. In addition, the carrying magnetic pole is included next to the dividing magnetic pole, and thus in a tangential component T1 in a location in which the normal component of the magnetic flux density of the dividing magnetic pole falls down, a high value is secured. Meanwhile, it goes without saying that the normal component (equivalent to R3 in the drawing) of the magnetic flux density of the developing magnetic pole becomes larger than the normal component of the magnetic flux density of the dividing magnetic pole disposed opposite thereto.

Figure 20:
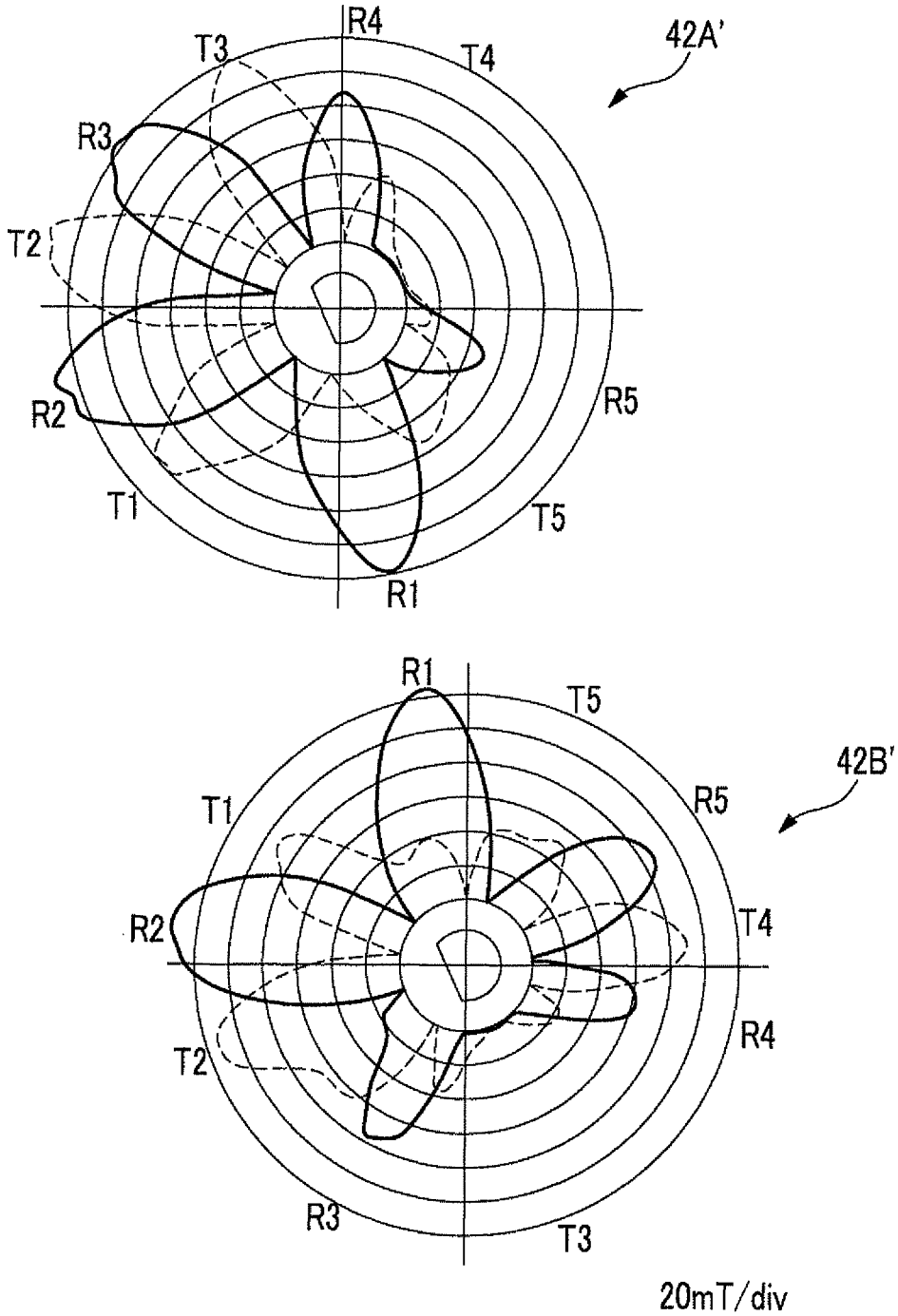
FIG. 20 is a diagram illustrating an example of magnetic patterns when five-pole developing rollers are disposed opposite to each other as a comparative example.

On the other hand, FIG. 20 is a diagram illustrating magnetic patterns when the number of magnetic poles having no carrying magnetic pole is five, as a comparative example. In this case, since the developing magnetic pole (magnetic pole equivalent to R2 in the drawing) is disposed at a position adjacent to the downstream side of the dividing magnetic pole (magnetic pole equivalent to R1 in the drawing), the tangential component T1 of the magnetic flux density between both becomes small in the vicinity of the dividing magnetic pole due to the influence between the dividing magnetic poles, and is inclined toward the developing magnetic pole. For this reason, the tangential component T1 in a location in which the normal component of the magnetic flux density of the dividing magnetic pole falls down becomes very small, and becomes large when the tangential component comes close to the developing magnetic pole. For this reason, the developer after division tends to be peeled off from the developing rollers 42A' and 42B'.

In the present example, since the tangential component (equivalent to T1 in FIG. 18) of the magnetic flux density immediately after division has a high value by providing the carrying magnetic pole between the dividing magnetic pole and the developing magnetic pole, the peeling off of the developer from the developing rollers 42A and 42B immediately after division is suppressed, and the developer is stably carried. Thereby, a developer layer in which a fluctuation in a division ratio is suppressed and a fluctuation in the thickness of developer is small is carried to the development area. On the other hand, in the comparative example, since the tangential component of magnetic flux density immediately after division is small, the developer immediately after division tends to be peeled off from the developing rollers 42A' and 42B', a division ratio tends to fluctuate, and the developer layer of which the thickness tends to fluctuate is carried to the development area.

In this case, the same is true of a case where in the division location, the dividing magnetic pole and the carrying magnetic pole of the developing roller different from the developing roller to which the developer is supplied is biasedly disposed at the upstream side, and it goes without saying that the same is true of a case where the width of the carrying magnetic pole is set to be larger than the width of the dividing magnetic pole.

Example 2

Figure 21:
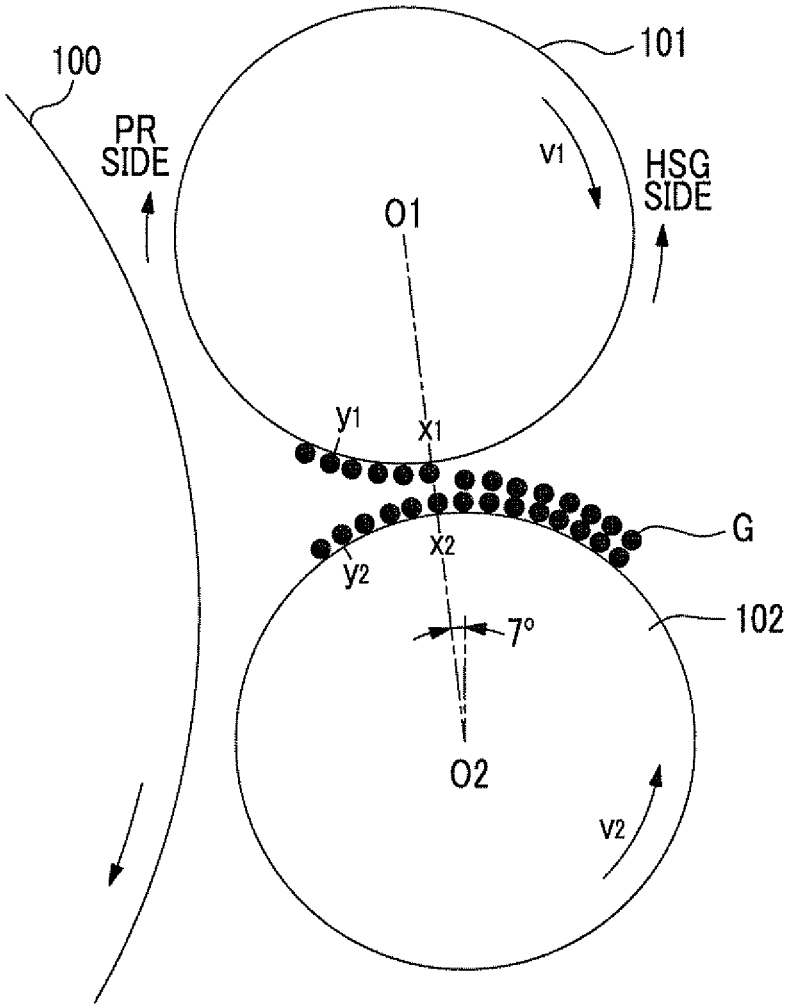
FIG. 21 is a diagram illustrating an arrangement of evaluation models of example 2.

In the present example, as shown in FIG. 21, substantially similarly to the configuration of Exemplary Embodiment 1, in an example in which two developing rollers 101 and 102 are lined up vertically inclined by 7 degrees from the vertical direction, and developer G is supplied to the lower developing roller 102, when the angle of the upper developing roller 101 is changed, that is, when a position relationship between a dividing magnetic pole and a carrying magnetic pole in the upper and lower developing rollers 101 and 102 is changed, it is confirmed what the division ratio of the developer is. Here, the dividing magnetic pole is set to x1 and x2, and the carrying magnetic pole is set to y1 and y2. Meanwhile, reference numeral 100 is a photoreceptor.

In such a configuration, evaluation is made under the following conditions.

- Half-value width of dividing magnetic poles x1 and x2: constant (here, 20 degrees)
- Magnetic flux density of dividing magnetic poles x1 and x2: 90 mT (simplex)
- Half-value width of carrying magnetic poles y1 and y2: two levels of 30 degrees and 20 degrees
- Magnetic flux density of carrying magnetic poles y1 and y2: 100 mT (simplex)
- Circumferential speeds v1 and v2 of developing roller: $v1 \approx v2$ In addition, the developer G is supplied from the lower developing roller 102 side, and the amount of developer supplied is set to two levels (low MOS, high MOS: mass On Sleeve) by changing a gap between the regulation member and the roller. Further, the angle (referred to as an upper MSA: MSA=Magroll Set Angle) is changed in the rotation direction centering on a central axis O1 of the upper developing roller 101. At this time, in the present example, when the lower developing roller 102 is installed, the position of a dividing magnetic pole β2 of the lower developing roller 102 deviates to the side located five degrees further upstream than a line segment that links the central axis O1 of the upper developing roller 101 and a central axis O2 of the lower developing roller 102, but confirmation is made in this state.

Figure 22:
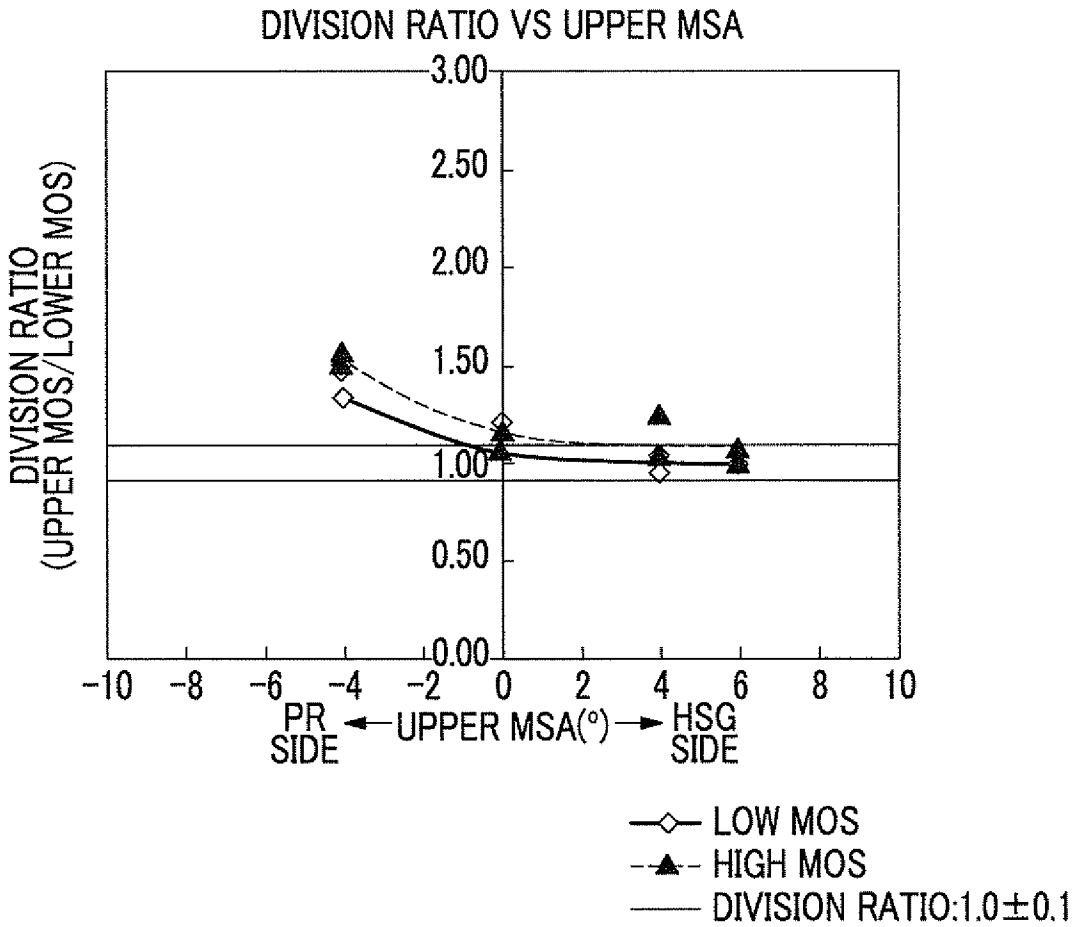
FIG. 22 is a graph showing a result of example 2, and is a graph illustrating a case where the half-value width of the carrying magnetic pole is 30°.
Figure 23:
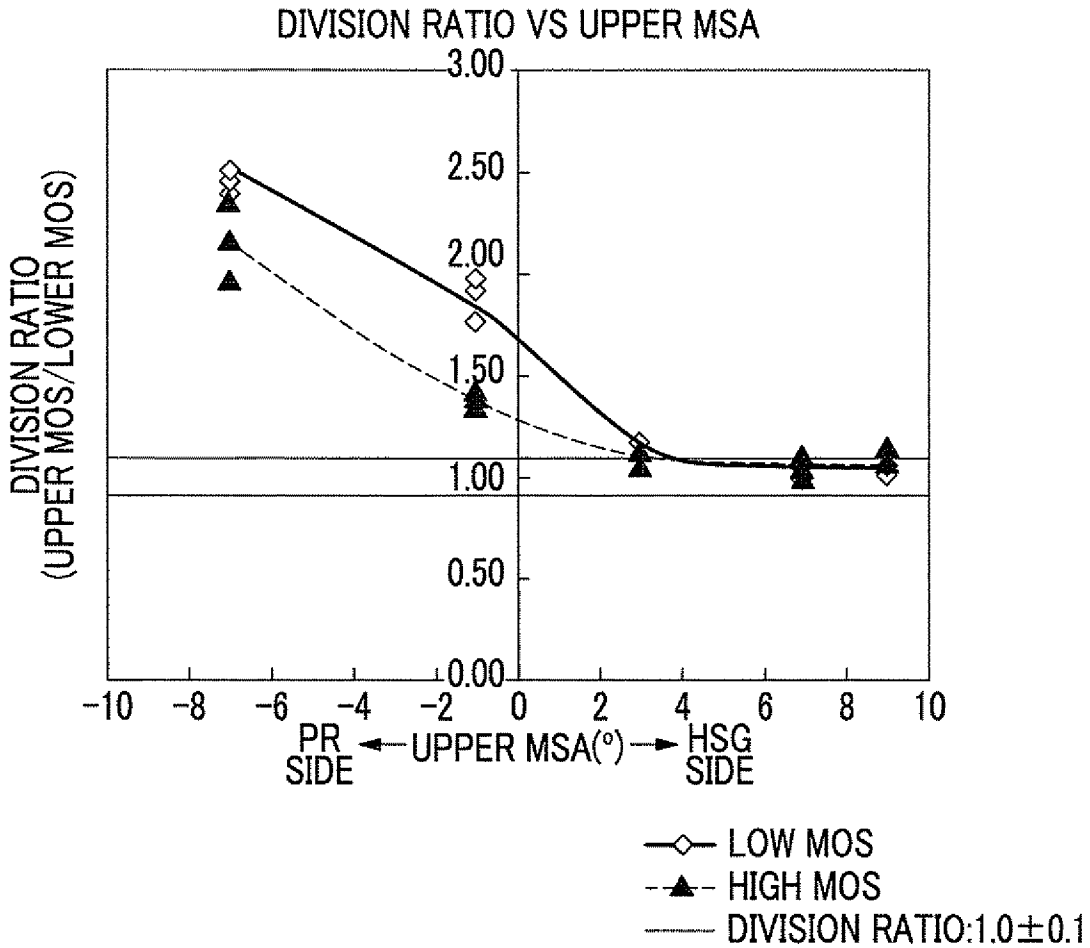
FIG. 23 is a graph showing a result of example 2, and is a graph illustrating a case where the half-value width of the carrying magnetic pole is 20°.

As an evaluation content, each of the amounts of developer attached (referred to as upper MOS and lower MOS) on the upper developing roller 101 and the lower developing roller 102 after the developer G is divided is obtained, and the ratio thereof (upper MOS/lower MOS) is calculated. A result based on such conditions when the half-value width of the carrying magnetic poles y1 and y2 is 30 degrees is shown in FIG. 22, and a result when the half-value width of the carrying magnetic poles y1 and y2 is 20 degrees is shown in FIG. 23.

From FIG. 21, the following points are confirmed.

The rotation of the upper MSA toward the developing container (HSG) side, that is, the biasing of the magnetic poles x1 and y1 of the upper developing roller 101 toward the upstream side tend to set the division ratio of the developer to 1:1.

When the upper MSA is rotated toward the photoreceptor (PR) side, that is, the magnetic poles x1 and y1 of the upper developing roller 101 is biased toward the downstream side, a great deal of developer is divided onto the upper developing roller 101 side, and when the angle of rotation is slightly changed, the division ratio is changed.

Even when the amount of developer supplied is changed, a relationship between the upper MSA and the division ratio transitions substantially similarly.

In order to set the division ratio to substantially 1:1 even when the amount of developer supplied is changed, the upper developing roller 101 is preferably rotated 2 to 6 degrees toward the developing container side.

From FIG. 22, the following points are confirmed.

The rotation of the upper MSA toward the developing container (HSG) side, that is, the biasing of the magnetic poles x1 and y1 of the upper developing roller 101 toward the upstream side tend to set the division ratio of the developer to 1:1.

When the upper MSA is rotated toward the photoreceptor (PR) side, that is, the magnetic poles x1 and y1 of the upper developing roller 101 is biased toward the downstream side, a greater deal of developer is divided onto the upper developing roller 101 rather than when the half-value width of the carrying magnetic pole is 30 degrees, and the division ratio is greatly changed only by changing the angle of rotation slightly.

When the amount of developer supplied is caused to increase, the amount of increase in the developer of the upper developing roller 101 decreases further than when the amount of developer supplied is caused to decrease.

In order to set the division ratio to substantially 1:1 even when the amount of developer supplied is changed, the upper developing roller 101 is preferably rotated 4 to 9 degrees toward the developing container side.

From the above, it is understood that the half-value width (equivalent to magnetic pole width) of 20 degrees of the carrying magnetic pole can stabilize the division ratio than that of 30 degrees.

Further, the inventor has confirmed that as a result of performing the same evaluation as that in the present example by changing the peak value of the magnetic flux density of the mutual dividing magnetic pole in two developing rollers, the developer is divided with a similar tendency though the division ratios are different from each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developer holding member, disposed opposite to an image holding member that holds an electrostatic latent image and cyclically moves, which rotates in a reverse direction to the image holding member at an opposite location to the image holding member and holds and carries developer, containing toner and magnetic carrier, toward a first development area on which the electrostatic latent image on the image holding member is developed;

a second developer holding member, disposed opposite to the image holding member and the first developer holding member at the side located further downstream of the image holding member in a direction of movement than the first developer holding member, which rotates in the same direction as the first developer holding member at an opposite location to the first developer holding member and holds and carries the developer toward a second development area on which the electrostatic latent image on the image holding member is developed;

a developer supply mechanism that supplies the developer to a position located further downstream than the second development area in a direction of rotation of the second developer holding member and located further upstream than opposite locations of the first and second developer holding members, with respect to any one of the first and second developer holding members;

a regulation member that regulates the developer supplied by the developer supply mechanism to an amount necessary to be provided for use in development at both the first and second developer holding members;

a developer division unit that has dividing magnetic poles having polarities different from each other, respectively disposed at the opposite locations of the first and second developer holding members, and divides the developer, supplied from the developer supply mechanism due to a dividing magnetic field formed by the dividing magnetic poles and carried to the opposite locations of the two developer holding members, into two parts for the two developer holding members;

a developer carrying unit that has carrying magnetic poles, respectively, disposed between each of the dividing magnetic poles and each developing magnetic pole corresponding to each of the first and second development areas in the first and second developer holding members, the carrying magnetic poles having a polarity different from both the poles, and holds and carries the developer after division toward each of the first and second development areas in a state where the developer after division is separated, while increasing a magnetic flux density of a location adjacent to the developer division unit further than when the carrying magnetic poles are not present due to a magnetic flux density distribution of the carrying magnetic poles; and a rotating member with the magnetic poles fixedly disposed inside the rotating member.

2. The developing device according to claim 1, wherein the developer division unit is configured such that a central position of a magnetic pole width along a circumferential direction of the dividing magnetic pole of the developer holding member, out of the dividing magnetic pole, located on a different side from the developer holding member to which the developer is supplied by the developer supply mechanism is set to be biased toward the upstream side of the developer holding member in the direction of rotation, with respect to a central position of a magnetic pole width along a circumferential direction of the dividing magnetic pole of the developer holding member to which the developer is supplied by the developer supply mechanism.

3. The developing device according to claim 2, wherein when a half-value width of a normal component of magnetic flux density caused by the dividing magnetic pole of each of the first and second developer holding members is set to θ1, and a half-value width of a normal component of magnetic flux density caused by the carrying magnetic pole is set to θ2, both the dividing magnetic pole and the carrying magnetic pole in each of the first and second developer holding members are set to satisfy a relationship of $\theta 1<\theta 2$.

4. The developing device according to claim 3, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

5. The developing device according to claim 3, wherein the developer carrying unit is configured such that a central position of a magnetic pole width along a circumferential direction of the carrying magnetic pole on the developer holding member side, out of the carrying magnetic poles, located on a different side from the developer holding member to which the developer is supplied by the developer supply mechanism is set to be biased toward the upstream side of the developer holding member in the direction of rotation, with respect to a central position of a magnetic pole width along a circumferential direction of the carrying magnetic pole of the developer holding member to which the developer is supplied by the developer supply mechanism.

6. The developing device according to claim 5, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

7. The developing device according to claim 2, wherein the developer carrying unit is configured such that a central position of a magnetic pole width along a circumferential direction of the carrying magnetic pole on the developer holding member side, out of the carrying magnetic poles, located on a different side from the developer holding member to which the developer is supplied by the developer supply mechanism is set to be biased toward the upstream side of the developer holding member in the direction of rotation, with respect to a central position of a magnetic pole width along a circumferential direction of the carrying magnetic pole of the developer holding member to which the developer is supplied by the developer supply mechanism.

8. The developing device according to claim 7, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

9. The developing device according to claim 2, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

10. The developing device according to claim 1, wherein when a half-value width of a normal component of magnetic flux density caused by the dividing magnetic pole of each of the first and second developer holding members is set to θ1, and a half-value width of a normal component of magnetic flux density caused by the carrying magnetic pole is set to θ2, both the dividing magnetic pole and the carrying magnetic pole in each of the first and second developer holding members are set to satisfy a relationship of $\theta 1<\theta 2$.

11. The developing device according to claim 10, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

12. The developing device according to claim 10, wherein the developer carrying unit is configured such that a central position of a magnetic pole width along a circumferential direction of the carrying magnetic pole on the developer holding member side, out of the carrying magnetic poles, located on a different side from the developer holding member to which the developer is supplied by the developer supply mechanism is set to be biased toward the upstream side of the developer holding member in the direction of rotation, with respect to a central position of a magnetic pole width along a circumferential direction of the carrying magnetic pole of the developer holding member to which the developer is supplied by the developer supply mechanism.

13. The developing device according to claim 12, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

14. The developing device according to claim 1, wherein the developer carrying unit is configured such that a central position of a magnetic pole width along a circumferential direction of the carrying magnetic pole on the developer holding member side, out of the carrying magnetic poles, located on a different side from the developer holding member to which the developer is supplied by the developer supply mechanism is set to be biased toward the upstream side of the developer holding member in the direction of rotation, with respect to a central position of a magnetic pole width along a circumferential direction of the carrying magnetic pole of the developer holding member to which the developer is supplied by the developer supply mechanism.

15. The developing device according to claim 14, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

16. The developing device according to claim 1, wherein the developer holding member to which the developer is supplied by the developer supply mechanism includes at least the developing magnetic pole, the dividing magnetic pole and the carrying magnetic pole, and includes seven magnetic poles therein along the direction of rotation of the developer holding member.

17. An image forming device comprising:

an image holding member that holds an electrostatic latent image and cyclically moves; and the developing device according to claim 1 which is provided opposite to the image holding member and develops the electrostatic latent image on the image holding member with the developer.

18. The image forming device according to claim 17, further comprising:

one or a plurality of additional developer holding members, provided separately from the first and second developer holding members, which are disposed opposite to the image holding member and hold and carry the developer toward a development area opposite to the image holding member; and a delivery unit that delivers the developer held and carried on the first and second developer holding members to the additional developer holding members.

19. A developing device comprising:

a first developer holding member, disposed opposite to an image holding member that holds an electrostatic latent image and cyclically moves, which rotates in a reverse direction to the image holding member at an opposite location to the image holding member and holds and carries developer, containing toner and magnetic carrier, toward a first development area on which the electrostatic latent image on the image holding member is developed;

a second developer holding member, disposed opposite to the image holding member and the first developer holding member at the side located further downstream of the image holding member in a direction of movement than the first developer holding member, which rotates in the same direction as the first developer holding member at an opposite location to the first developer holding member and holds and carries the developer toward a second development area on which the electrostatic latent image on the image holding member is developed;

a developer supply mechanism that supplies the developer to a position located further downstream than the second development area in a direction of rotation of the second developer holding member and located further upstream than opposite locations of the first and second developer holding members, with respect to any one of the first and second developer holding members;

a regulation member that regulates the developer supplied by the developer supply mechanism to an amount necessary to be provided for use in development at both the first and second developer holding members;

a developer division unit that has dividing magnetic poles having polarities different from each other, respectively, disposed at the opposite locations of the first and second developer holding members, and divides the developer, supplied from the developer supply mechanism due to a dividing magnetic field formed by the dividing magnetic poles and carried to the opposite locations of the two developer holding members, into two parts for the two developer holding members;

a developer carrying unit that has one or more carrying magnetic poles, respectively, disposed between each of the dividing magnetic poles and each developing magnetic pole corresponding to each of the first and second development areas in the first and second developer holding members so that magnetic poles adjacent to each other including the dividing magnetic poles and the developing magnetic poles have different polarities, and holds and carries the developer after division toward each of the first and second development areas in a state where the developer after division is separated, while increasing a magnetic flux density of a location adjacent to the developer division unit further than when the carrying magnetic poles are not present due to a magnetic flux density distribution of the carrying magnetic poles; and a rotating member with the magnetic poles fixedly disposed inside the rotating member.

* * * * *